US010081924B2

(12) United States Patent
Uiyyasathian

(10) Patent No.: US 10,081,924 B2
(45) Date of Patent: Sep. 25, 2018

(54) SYSTEMS AND METHODS FOR REUSING AN OFFSHORE PLATFORM

(71) Applicant: PTT Exploration and Production Public Company Limited, Bangkok (TH)

(72) Inventor: Sarayut Uiyyasathian, Bangkok (TH)

(73) Assignee: PTT Exploration and Production Public Company Limited, Bangkok (TH)

( * ) Notice: Subject to any disclaimer, the term of this patent is extended or adjusted under 35 U.S.C. 154(b) by 0 days.

(21) Appl. No.: 15/957,674

(22) Filed: Apr. 19, 2018

(65) Prior Publication Data

US 2018/0238010 A1 Aug. 23, 2018

Related U.S. Application Data

(63) Continuation of application No. 15/308,361, filed as application No. PCT/TH2015/000089 on Dec. 8, 2015, now Pat. No. 9,988,783.

(51) Int. Cl.
*E02B 17/02* (2006.01)
*E02B 17/00* (2006.01)

(52) U.S. Cl.
CPC .... *E02B 17/027* (2013.01); *E02B 2017/0039* (2013.01); *E02B 2017/0052* (2013.01); *E02B 2017/0073* (2013.01)

(58) Field of Classification Search
CPC ..... E02B 17/00; E02B 17/02; E02D 29/00; B63B 35/04; B63B 21/00
See application file for complete search history.

(56) References Cited

U.S. PATENT DOCUMENTS

| | | | | |
|---|---|---|---|---|
| 3,557,564 A | | 1/1971 | Hauber | |
| 4,818,145 A | | 4/1989 | Carruba | |
| 4,966,496 A | | 10/1990 | Stelzer | |
| 5,028,171 A | | 7/1991 | Gray | |
| 5,558,469 A | | 9/1996 | Hellerman | |
| RE35,912 E | * | 9/1998 | Gomez de Rosas | ... E21B 17/01 405/195.1 |

(Continued)

FOREIGN PATENT DOCUMENTS

| | | |
|---|---|---|
| EP | 2067913 A2 | 6/2009 |
| WO | 2017099672 A1 | 6/2017 |

OTHER PUBLICATIONS

International Search Report and Written Opinion of the International Searching Authority (US) for International Application No. PCT/TH2015/000089; dated Apr. 29, 2016.

*Primary Examiner* — Tara Mayo-Pinnock
(74) *Attorney, Agent, or Firm* — Baker & McKenzie LLP

(57) ABSTRACT

Example embodiments relate to apparatuses, systems, and methods for securing an offshore platform to a bottom of a body of water comprising a shear assembly and a sleeve assembly. The shear assembly is operable to secure to the offshore platform at a first end and having a first connector portion at a second end. The sleeve assembly comprises a sleeve body forming an interior opening, the interior opening operable to receive at least a pile. The sleeve assembly further comprises a second connector portion secured to the sleeve body, the second connector portion securable to and un-securable from the first connector portion of the shear assembly.

14 Claims, 18 Drawing Sheets

(56) References Cited

U.S. PATENT DOCUMENTS

| | | | |
|---|---|---|---|
| 8,920,061 | B2 | 12/2014 | Quinta Cortinas |
| 2013/0340376 | A1 | 12/2013 | Quinta Cortinas |
| 2018/0038060 | A1 | 2/2018 | Uiyyasathian |

* cited by examiner

SYSTEMS AND METHODS FOR REUSING AN OFFSHORE PLATFORM

CROSS-REFERENCE TO RELATED APPLICATIONS

This application is a continuation of U.S. application Ser. No. 15/308,361 (filed on Nov. 1, 2016), which is a National Stage Application of PCT International Application No. PCT/TH2015/000089 (filed on Dec. 8, 2015), the contents of all of which are hereby expressly incorporated by reference in their entirety, including the contents and teachings of any references contained therein.

BACKGROUND

The present disclosure relates generally to an offshore platform, and more specifically, relates to apparatuses, systems, and methods for installing/securing an offshore platform to a bottom of a body of water and uninstalling/un-securing an offshore platform from a bottom of a body of water for re-use of same.

A typical offshore platform comprises, among other things, a purposively designed body structure having an overall height sufficient for at least an upper platform portion of the offshore platform to persistently extend above a water line when a base (i.e. the legs) of the offshore platform is secured to a bottom of a body of water (such as an ocean floor).

In general, an offshore platform is constructed on dry land, loaded onto a transport ship, transported to a desired location, and lowered in an upright position to a bottom of a body of water. The offshore platform is then permanently secured (or installed or anchored or locked) in place to the bottom of the body of water. Such permanent securing typically includes, among other things, an insertion of an elongated anchoring structure (a "pile") into a corresponding receiving portion (a "sleeve") that is permanently attached to a leg of the offshore platform; driving the pile sufficiently deep into the bottom of the body of water; repeating the inserting and driving of additional piles into other sleeves of the offshore platform; and filling grout, or the like, into remaining space(s) between an exterior surface of each of the piles and an interior surface of each of the corresponding sleeves so as to permanently secure the piles to the corresponding sleeves.

Recently, other methods of permanently securing a pile to a corresponding sleeve have been developed to replace and/or compliment the filling of grout, or the like. For example, swaging, or the like, has been used to create protruding portions to permanently secure a pile to a corresponding sleeve. A typical swaging operation may include, among other things, the use of a purposively designed sleeve having an interior surface that includes one or more indentations, bores, or the like. In operation, after a pile is inserted into a corresponding sleeve, a specialized tool may be inserted into an interior channel portion of the pile. The specialized tool may then be actuated so as to "push," or expand, one or more portions of the pile outwardly into the indentation(s) of the interior surface of the sleeve so as to create protruding portions of the pile. The protruded portions of the pile may then be operable to cooperate with the indentations of the interior surface of the sleeve so as to permanently secure the pile to the corresponding sleeve. To complete the securing of the offshore platform, this process is then repeated for all of the piles inserted into all of the sleeves of the offshore platform.

BRIEF SUMMARY

Despite recent developments in offshore platform technology, it is recognized in the present disclosure that un-securing and/or re-using already installed/secured offshore platforms is generally very difficult, problematic, time-consuming, and/or financially infeasible to perform.

For example, an offshore platform secured to a bottom of a body of water wherein each pile is permanently secured to a corresponding sleeve by filling grout, performing swaging, or the like, will generally require tremendous efforts by divers with specialized training (or underwater robots/submarines) and specialized underwater cutting tools to reach the bottom of the body of water and sever each pile in or about a point between a bottom of each corresponding sleeve and the bottom of the body of water. After all of the piles anchoring the offshore platform are severed, the entire offshore platform, including the severed portion of each pile permanently secured to each sleeve, may then be lifted up, brought onto a transport ship, transported to dry land, and lifted off the ship and onto a dry working surface. Tremendous efforts are then generally required to remove all remaining severed portions of each pile from each corresponding sleeve which, as previously explained, are secured together by grouting and/or swaging operations, or the like.

Present example embodiments relate generally to apparatuses, systems, and methods for securing and/or un-securing offshore platforms to and/or from a bottom of a body of water, respectively.

In an exemplary embodiment, an apparatus is provided for securing an offshore platform to a bottom of a body of water. The apparatus comprises an example embodiment of a shear assembly and an example embodiment of a sleeve assembly, the shear assembly and the sleeve assembly operable to secure to and/or un-secure (or detach) from one another via a first connector portion and second connector portion when securing and/or un-securing/re-using of the offshore platform is desired, respectively. The shear assembly is operable to secure to the offshore platform at a first end. For example, the first end of the shear assembly may be secured to a leg of the offshore platform. The shear assembly comprises a first connector portion at a second end of the shear assembly. The sleeve assembly comprises a sleeve body forming an interior opening. The interior opening is operable to receive or house at least a pile. The filling of grout, or the like, or the performing of swaging, or the like, may be further performed so as to secure the pile to the interior opening of the sleeve body when performing a securing of the offshore platform to the bottom of the body of water. The sleeve assembly further comprises a second connector portion secured to the sleeve body. The second connector portion is securable to the first connector portion of the shear assembly when performing a securing of the offshore platform to the bottom of the body of water. The second connector portion is un-securable from the first connector portion of the shear assembly when performing an un-securing and/or re-using of the offshore platform from the bottom of the body of water.

In another exemplary embodiment, an apparatus is provided for securing an offshore platform to a bottom of a body of water. The apparatus comprises an example embodiment of a shear assembly, example embodiment of a sleeve assembly, and example embodiment of a connector assembly, the shear assembly and the sleeve assembly operable to secure to and/or un-secure (or detach) from one another via the connector assembly when securing and/or un-securing/re-using of the offshore platform is desired, respectively. The shear assembly is operable to secure to a portion of the offshore platform at a first end. For example, the first end of the shear assembly may be secured to a leg of the offshore platform. The sleeve assembly comprises a sleeve body forming an interior opening. The interior opening is operable to receive or house at least a pile. The connector assembly comprises a first connector end securable to a portion of the shear assembly. The connector assembly further comprises a second connector end securable to a portion of the sleeve body. The connector assembly is un-securable from the shear assembly and/or the sleeve assembly when performing an un-securing and/or re-using of the offshore platform from the bottom of the body of water.

In another exemplary embodiment, an apparatus is provided for securing an offshore platform to a bottom of a body of water. The apparatus comprises an example embodiment of a sleeve assembly and an example embodiment of a shear assembly, the sleeve assembly transitionable between a secured position and an un-secured position when securing and/or un-securing/re-using of the offshore platform is desired, respectively. The sleeve assembly comprises a first sleeve body portion and a second sleeve body portion. The first sleeve body portion comprises an interior surface and a first connector portion. The second sleeve body portion comprises an interior surface and a second connector portion. The second connector portion is securable to the first connector portion when performing a securing of the offshore platform to the bottom of the body of water. The second connector portion is un-securable from the first connector portion when performing an un-securing and/or re-using of the offshore platform from the bottom of the body of water. The sleeve assembly further comprises an interior opening formable by a cooperation of the interior surfaces of the first and second sleeve body portions when the first and second sleeve body portions are secured together. The interior opening is operable to receive or house at least a pile. The shear assembly comprises a first end operable to secure to the offshore platform. For example, the first end of the shear assembly may be secured to a leg of the offshore platform. The shear assembly further comprises a second end operable to secure to a portion of the sleeve assembly. For example, the second end of the shear assembly may be secured to the first sleeve body portion and/or the second sleeve body portion.

In another exemplary embodiment, an apparatus is provided for securing an offshore platform to a bottom of a body of water. The apparatus comprises an example embodiment of a sleeve assembly, example embodiment of a shear assembly, and example embodiment of a connector assembly, the shear assembly and the sleeve assembly operable to secure to and/or un-secure (or detach) from one another via the connector assembly when securing and/or un-securing/re-using of the offshore platform is desired, respectively. The sleeve assembly comprises a first sleeve body portion having an interior surface, a second sleeve body portion having an interior surface, and an interior opening formable by a cooperation of the interior surfaces of the first and second sleeve body portions when the first and second sleeve body portions are secured together. The interior opening is operable to receive or house at least a pile. The shear assembly comprises a first end operable to secure to a portion of the offshore platform. For example, the first end of the shear assembly may be secured to a leg of the offshore platform. The shear assembly further comprises a second end operable to secure to the sleeve assembly. For example, the second end of the shear assembly may be secured to the first sleeve body portion and/or the second sleeve body portion. The connector assembly comprises a connector assembly body. The connector assembly body comprises a first connector portion at a first end of the connector assembly body. The first connector portion is securable to a first end of the first sleeve body portion. The connector assembly body further comprises a second connector portion at a second end of the connector assembly body. The second connector portion is securable to a first end of the second sleeve body portion. The connector assembly is un-securable from the sleeve assembly when performing an un-securing and/or re-using of the offshore platform from the bottom of the body of water.

In another exemplary embodiment, an apparatus for securing an offshore platform to a bottom of a body of water is provided. The apparatus comprises a sleeve assembly and a shear assembly. The sleeve assembly comprises a first sleeve body portion and a second sleeve body portion. The first sleeve body portion comprises an interior opening and a first connector portion. The interior opening of the first sleeve body portion is operable to receive at least a portion of a pile. The second sleeve body portion is separate from the first sleeve body portion. The second sleeve body portion comprises an interior opening and a second connector portion. The second connector portion of the second sleeve body portion is securable to and un-securable from the first connector portion of the first sleeve body portion. The interior opening of the second sleeve body portion is operable to receive at least a portion of the pile. The shear assembly comprises a first end and a second end. The first end of the shear assembly is operable to secure to the offshore platform. The second end of the shear assembly is operable to secure to a portion of the sleeve assembly. The second end of the shear assembly is operable to secure to a portion of the first sleeve body portion. Alternatively or in addition, the second end of the shear assembly is operable to secure to a portion of the second sleeve body portion.

In another exemplary embodiment, a re-useable offshore platform is provided. The re-useable offshore platform comprises a pile, an offshore platform body having a base, and a securing assembly. The base comprises one or more legs. The securing assembly comprises an example embodiment of a shear assembly and an example embodiment of a sleeve assembly. The shear assembly is operable to secure to one of the legs. For example, a first end of the shear assembly may be secured to a leg of the offshore platform. The sleeve assembly is operable to secure to the shear assembly. The sleeve assembly comprises a sleeve body forming an interior opening. The interior opening is operable to receive or house at least the pile. The securing assembly is operable to secure the offshore platform to the pile and un-secure the offshore platform from the pile by engaging the securing assembly in a secured position and un-secured position, respectively.

In another exemplary embodiment, a method is provided for re-using an offshore platform secured to a bottom of a body of water. The offshore platform comprises a plurality of legs and a corresponding sleeve assembly and a shear assembly pair for each leg. Each shear assembly is secured to one of the legs at a first end and comprises a first connector portion at a second end. Each sleeve assembly comprises a sleeve body forming an interior opening operable to receive a pile. Each sleeve assembly further comprises a second connector portion secured to the sleeve body. The first and second connector portions of each sleeve assembly and corresponding shear assembly pair are engaged in a secured position. The method comprises transitioning the first and second connector portions of each sleeve assembly and corresponding shear assembly pair from the secured position to an un-secured position. The method further comprises separating each shear assembly from its corresponding sleeve assembly.

BRIEF DESCRIPTION OF THE DRAWINGS

For a more complete understanding of the present disclosure, example embodiments, and their advantages, reference is now made to the following description taken in conjunction with the accompanying drawings, in which like reference numbers indicate like features, and.

Although similar reference numbers may be used to refer to similar elements in the figures for convenience, it can be appreciated that each of the various example embodiments may be considered to be distinct variations.

DETAILED DESCRIPTION

Example embodiments will now be described with reference to the accompanying drawings, which form a part of the present disclosure and which illustrate example embodiments which may be practiced. As used in the present disclosure and the appended claims, the terms "example embodiment," "exemplary embodiment," and "present embodiment" do not necessarily refer to a single embodiment, although they may, and various example embodiments may be readily combined and/or interchanged without departing from the scope or spirit of example embodiments. Furthermore, the terminology as used in the present disclosure and the appended claims is for the purpose of describing example embodiments only and is not intended to be limitations. In this respect, as used in the present disclosure and the appended claims, the term "in" may include "in" and "on," and the terms "a," "an," and "the" may include singular and plural references. Furthermore, as used in the present disclosure and the appended claims, the term "by" may also mean "from," depending on the context. Furthermore, as used in the present disclosure and the appended claims, the term "if" may also mean "when" or "upon,"

depending on the context. Furthermore, as used in the present disclosure and the appended claims, the words "and/or" may refer to and encompass any and all possible combinations of one or more of the associated listed items.

Figure 1A:
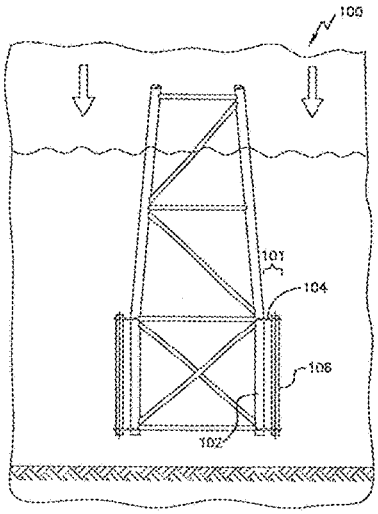
FIG. 1A is a side view illustration of an offshore platform being lowered into a body of water.
Figure 1B:
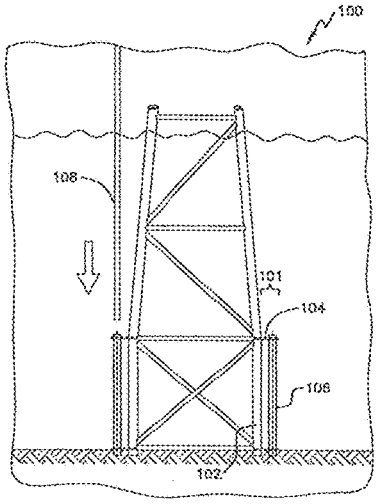
FIG. 1B is a side view illustration of an offshore platform placed onto a bottom of a body of water and piles being inserted into sleeves of the offshore platform.

As illustrated in FIGS. 1A and 1B, an offshore platform 100 may be constructed so as to comprise, among other things, a plurality of legs 102 forming a base of the offshore platform 100; a plurality of shears 104, each shear 104 being permanently attached to or constructed integrally with a leg 102; and a plurality of sleeves 106, each sleeve 106 being permanently attached to or constructed integrally with a shear 104. Such permanent attaching (or integral construction) of the sleeve 106 to the shear 104 and the shear 104 to the leg 102 may be achieved by welding, other permanent attaching methods, or constructing the leg 102, shear 104, and sleeve 106 so as to form a unitary article. In this regard, the said permanent attaching is required so as to ensure, among other things, the combination of the leg 102, shear 104, and sleeve 106 collectively provide anchoring and/or reactive forces sufficient to secure the overall offshore platform 100 to the bottom of the body of water via a plurality of piles 108.

Figure 1C:
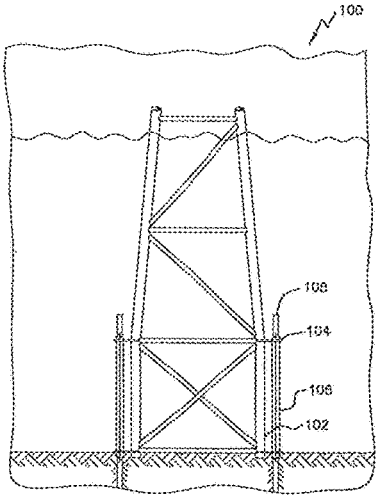
FIGS. 1C and 1D are side view illustrations of an offshore platform installed or secured to a bottom of a body of water.
Figure 1D:
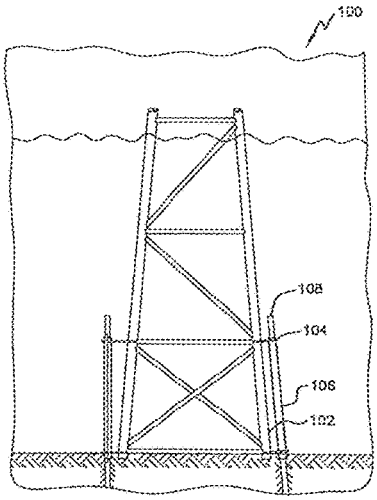

Offshore platforms are typically constructed on dry land, loaded onto a transport ship, transported to a desired location, lowered in an upright position to a bottom of a body of water (an example of which is illustrated in FIG. 1A), and permanently secured (or installed or anchored; hereinafter "secured" or "secure" or "securing", depending on the context) to the bottom of the body of water using a plurality of piles 108 inserted into corresponding sleeves 106 of the offshore platform 100 (an example of which is illustrated in FIG. 1B, FIG. 1C, and FIG. 1D).

It is recognized in the present disclosure that, despite recent developments in offshore platform technology, the un-securing and/or re-using (i.e. the un-securing/uninstalling and subsequent re-securing/reinstalling at a different location) of already secured offshore platforms, such as the offshore platform 100 illustrated in FIG. 1C, is generally very difficult, problematic, time-consuming, and/or financially infeasible to perform. For example, in a conventional approach, divers with specialized training (or underwater robots/submarines, etc.) and specialized underwater cutting tools are required to reach the bottom of the body of water and sever each and every pile in or about a point between the bottom of each corresponding sleeve and the bottom of the body of water. After severing all of the anchored piles, the offshore platform is lifted out of the water and transported to dry land. Thereafter, tremendous efforts, time, and resources will then be required to perform, among other things, removal of the remaining severed portions of each pile permanently secured to each corresponding sleeve of the offshore platform. Furthermore, such removal process may oftentimes result in the damaging of one or more portions of the sleeves and/or shears of the offshore platform, resulting in further significant repair and/or retrofit work required to bring the offshore platform to a re-useable condition for use in securing to a different location.

Systems, apparatuses, and methods, including those for use in offshore platforms, and the like, are described in the present disclosure for addressing one or more problems encountered in un-securing and/or re-using already-secured offshore platform systems, including those described above and in the present disclosure. It is to be understood that the principles described in the present disclosure can be applied outside of the context of offshore platforms secured to the bottom of a body of water, such as the un-securing and/or re-using of other types of structures securable to other surfaces and/or in other environments that are not readily accessible, including those in a vacuum, in outer space, and/or under toxic and/or dangerous conditions, without departing from the teachings of the present disclosure.

Example Embodiments of an Offshore Platform System (e.g., Offshore Systems 200, 600, and 1000)

As illustrated in at least FIGS. 2 to 10, an example embodiment of an offshore platform system 200, 600, and 1000 may be provided with, among other things, a plurality of legs 202 collectively forming a base of the offshore platform 200, 600, and 1000. The offshore platform 200, 600, and 1000 may also comprise one or more corresponding securing assemblies attachable to the base of the offshore platform, the securing assemblies operable to secure the offshore platform 200, 600, and 1000 to a bottom of a body of water via one or more piles. An example embodiment of a securing assembly may comprise a cooperation of elements, including an example embodiment of a shear assembly and example embodiment of a sleeve assembly.

When performing a securing operation, the elements of the securing assembly may be operable to cooperate with corresponding pile(s) so as to provide sufficient securing, anchoring, and/or reactive forces to secure the legs of the offshore platform system to the bottom of a body of water.

When performing an un-securing and/or re-use operation, one or more of the shear assembly and sleeve assembly may be operable to enable the offshore platform 200, 600, and 1000 to separate (or detach) from the installed piles (which are driven into the bottom of the body of water) in a substantially more simple and substantially less problematic, time consuming, and costly manner.

In example embodiments, such as those illustrated in at least FIGS. 2 to 5, one or more connections between a shear assembly 204 and sleeve assembly 206 of one or more securing assemblies 201 of the offshore platform 200 may be transitionable between a secured (or locked or installed or attached; hereinafter "secure" or "secured" or "securing" or "securable", depending on the context) position (securing operation) and an un-secured (or unlocked or uninstalled or detached; hereinafter "un-secure" or "un-secured" or "un-securing" or "un-securable", depending on the context) position (un-securing and/or re-use operation). In other example embodiments, such as those illustrated in at least FIGS. 6 to 9, one or more sleeve assemblies 606 of the offshore platform 600 may be transitionable between a secured (or locked or installed or attached; hereinafter "secure" or "secured" or "securing" or "securable", depending on the context) position (securing operation) and an un-secured (or unlocked or uninstalled or detached; hereinafter "un-secure" or "un-secured" or "un-securing" or "un-securable", depending on the context) position (un-securing and/or re-use operation). In other example embodiments, such as those illustrated in at least FIGS. 10A-D, one or more sleeve assemblies 1006 of the offshore platform 600 may be transitionable between a secured and an unsecured position. In other example embodiments (not shown), a shear assembly and a sleeve assembly of the offshore platform may be transitionable between a secured position (securing operation) and an un-secured position (un-securing and/or re-use operation). These and other example embodiments will now be described below with reference to at least FIGS. 2 to 12.

Securing/Locking and Un-Securing/Unlocking Between Shear Assembly (e.g., 204) and Sleeve Assembly (e.g., 206).

Figure 2A:
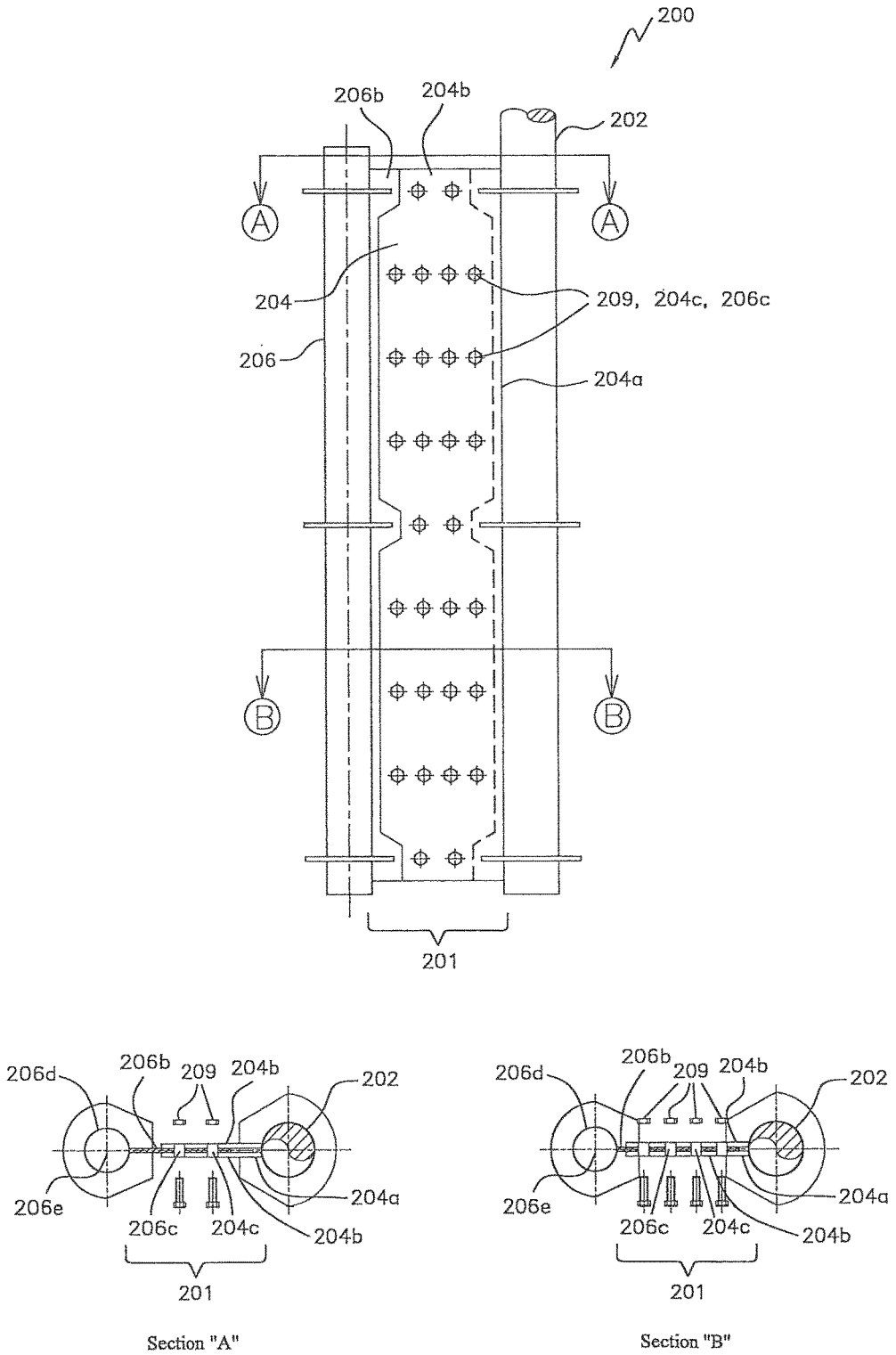
FIG. 2A is a side view illustration of an example embodiment of an offshore platform wherein the shear assembly is securable to and un-securable from the sleeve assembly.
Figure 2B:
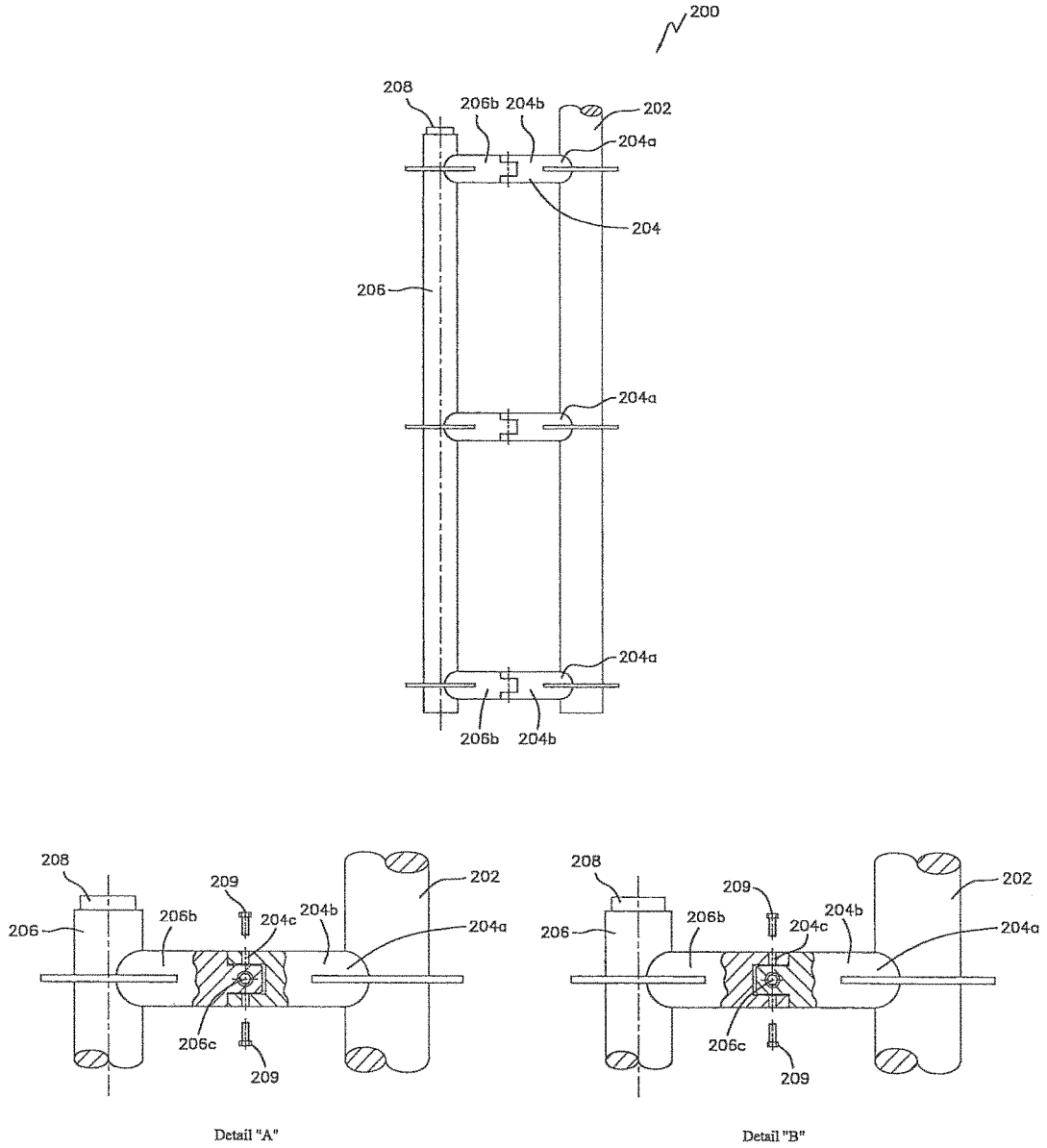
FIG. 2B is another side view illustration of other example embodiments of an offshore platform wherein the shear assembly is securable to and un-securable from the sleeve assembly.
Figure 2C:
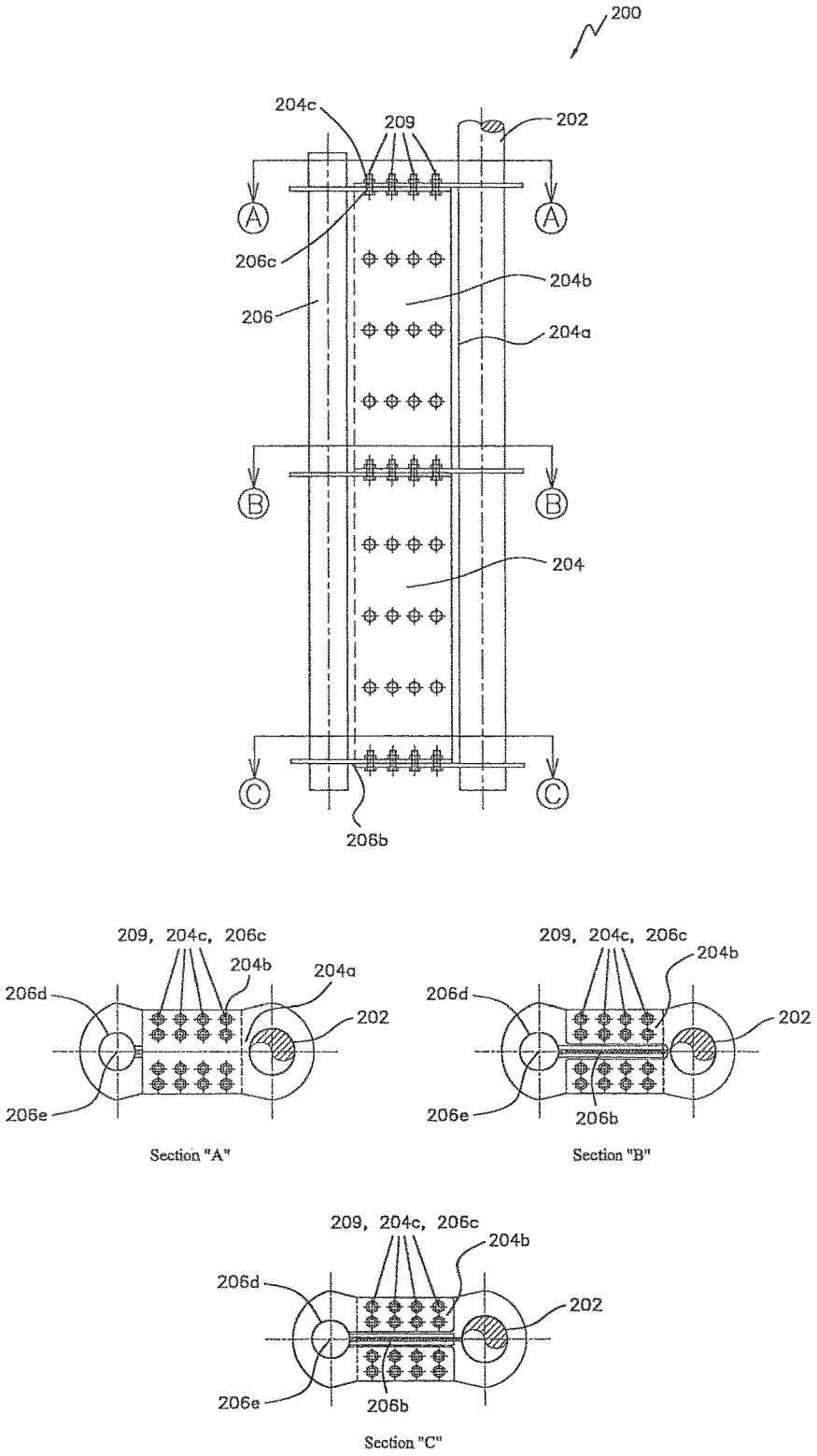
FIG. 2C is a top view illustration of an example embodiment of an offshore platform wherein the shear assembly is securable to and un-securable from the sleeve assembly.

As illustrated in at least FIG. 2A, an offshore platform 200 may comprise a shear assembly 204 and a sleeve assembly 206. The shear assembly 204 may be securable to the sleeve assembly 206 (when performing a securing operation) and un-securable from the sleeve assembly 206 (when performing an un-securing and/or re-use operation) via a connection between connector portion 204*b* and connector portion 206*b*. FIG. 2B illustrates a side perspective view of example embodiments of the shear assembly 204 and the sleeve assembly 206, and FIG. 2C illustrates a top perspective view of an example embodiment of the shear assembly 204 and the sleeve assembly 206.

The shear assembly 204 may be connected to a leg 202 of the offshore platform at a first end 204*a* of the shear assembly 204. For example, the first end 204*a* of the shear assembly 204 may be permanently attached to the leg 202, such as by welding or other known methods. The shear assembly 204 may comprise a connector portion 204*b*, and such connector portion 204*b* may be located at a second end of the shear assembly 204 opposite to the first end 204*a*. In an example embodiment, the connector portion 204*b* of the shear assembly 204 may comprise one or more receiving portions 204*c*, such as a threaded hole, bore, female-type connector, or the like. Each receiving portion 204*c* may be operable to receive a complimentary locking member 209, such as a screw, male-type connector, or the like. It is to be understood in the present disclosure that each receiving portion 204*c* and corresponding locking member 209 pair may be in other shapes and forms other than a screw and threaded hole pair, including any other lockable/unlockable connector type pairs. It is also to be understood that the first end 204*a* of the shear assembly 204 may not be permanently attached to the leg 202 of the offshore platform 200, but rather such attachment may be transitionable between a secured position (when performing a securing operation) and an un-secured position (when performing an un-securing and/or re-use operation).

The sleeve assembly 206 may comprise a sleeve body 206 having an interior surface 206*d* forming an interior opening 206*e* (or channel). The interior opening 206*e* may be operable to receive at least a pile 208. In example embodiments, the interior opening 206*e* may also be operable to receive an insertion of grout, or the like, between an exterior surface of the pile 208 and the interior surface 206*d* of the sleeve body 206 so as to secure the pile 208 to the sleeve body 206. It is to be understood in the present disclosure that other methods and forms of securing the pile 208 to the sleeve body 206, such as by swaging, or the like, are contemplated without departing from the teachings of the present disclosure. It is also to be understood in the present disclosure that the interior opening 206*e* of the sleeve assembly 206 may be in any shape or form so long as the interior opening 206*e* is operable to receive and house at least a corresponding pile 208. From a cross-sectional perspective, the interior opening 206*e* may be in the shape of a circular, elliptical, square, rectangular, or other shaped cross-section. From an overall channel perspective, the interior opening 206*e* may be in the form of an elongated cylindrical, elliptical, square, rectangular, or other shaped channel.

The sleeve assembly 206 may further comprise a connector portion 206*b* attached to the sleeve body 206. The connector portion 206*b* of the sleeve assembly 206 may be operable to secure to connector portion 204*b* of the shear assembly 204 (when performing a securing operation) and un-secure from connector portion 204*b* of the shear assembly 204 (when performing an un-secure and/or re-use operation).

The connector portion 206*b* of the sleeve assembly 206 may comprise one or more receiving portions 206*c*, such as a threaded hole, bore, female-type connector, or the like, similar to or substantially the same as the receiving portions 204*c* of the shear assembly 204. Each receiving portion 206*c* may be operable to receive a complimentary locking member 209, such as a screw, a male-type connector, or the like. It is to be understood in the present disclosure that each receiving portion 206*c* and corresponding locking member 209 pair may be in other shapes and forms other than a screw and threaded hole pair, including any other lockable/unlockable connector type pairs. It is also to be understood in the present disclosure that the receiving portions 204*c* and/or 206*c* and/or the locking members for use in inserting and locking into the receiving portions 204*c* and/or 206*c* (when performing a securing operation) and unlocking and removing from the receiving portions 204*c* and/or 206*c* (when performing an un-securing and/or re-use operation) may be the same, similar, or different receiving portions and/or types of locking members, respectively.

Figure 3A:
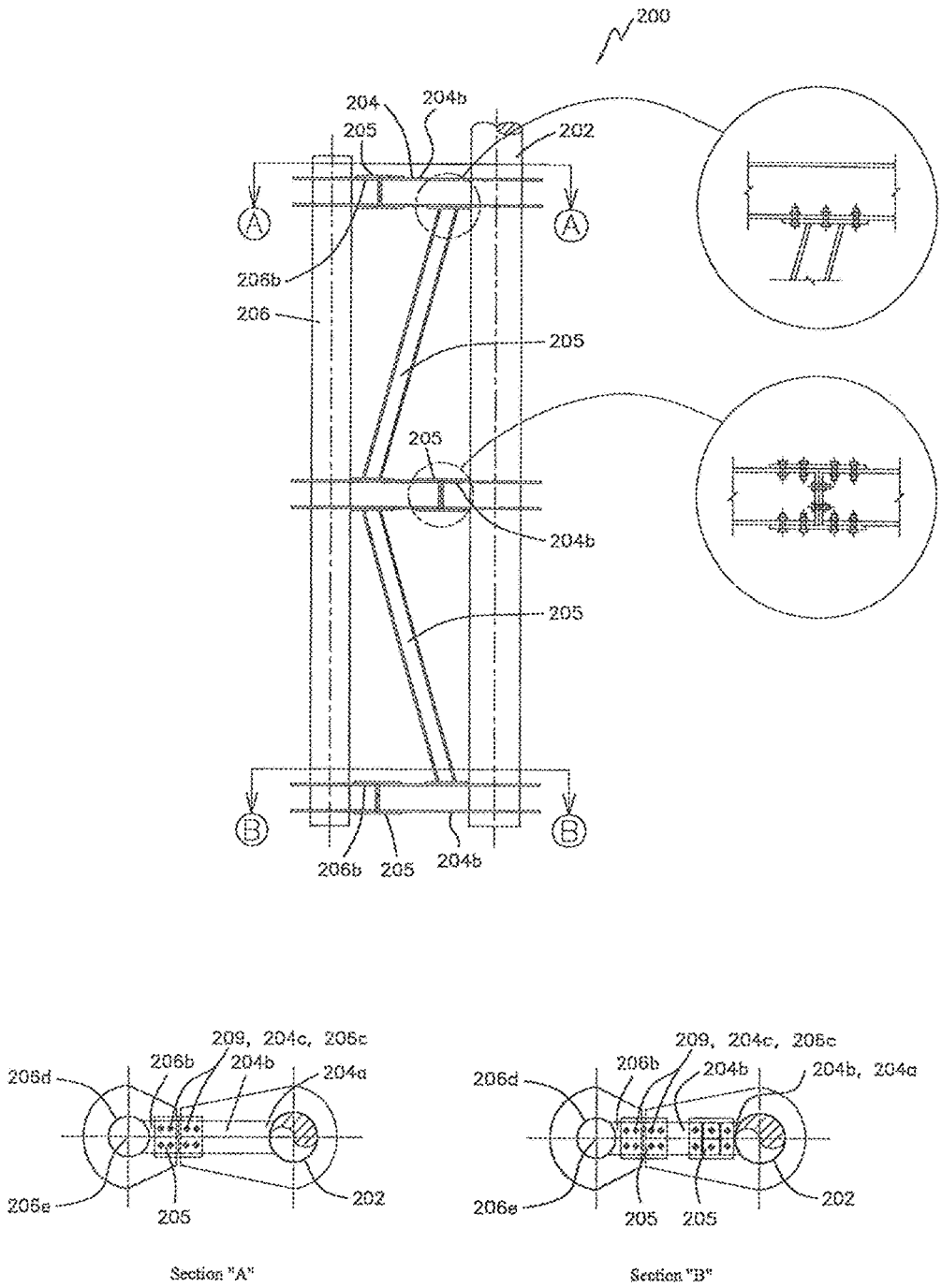
FIG. 3A is a side view illustration of another example embodiment of an offshore platform wherein the shear assembly is securable to and un-securable from the sleeve assembly via a connector assembly.

FIG. 3A illustrates another example embodiment of an offshore platform 200. The offshore platform 200 comprises a shear assembly 204, sleeve assembly 206, and connector assembly 205. The shear assembly 204 may be securable to the sleeve assembly 206 via the connector assembly 205 (when performing a securing operation) and un-securable from the sleeve assembly 206 via the connector assembly 205 (when performing an un-securing and/or re-use operation).

As can be seen, FIG. 3A illustrate example embodiments similar to the example embodiments illustrated in FIGS. 2A, 2B, and 2C. The example embodiments illustrated in FIG. 3A further comprise connector assembly 205 that may be operable to provide further support and/or strength to the securing of the shear assembly 204 to the sleeve assembly 206. When performing a securing operation, the connector portion 206*b* of the sleeve assembly 206 is operable to secure to a connector portion 205*a* of the connector assembly 205 and the connector portion 204*b* of the shear assembly 204 is operable to secure to a connector portion 205*b* of the connector assembly 205. Similarly, when performing an un-securing and/or re-use operation, the connector portion 206*b* of the sleeve assembly 206 is operable to un-secure from a connector portion 205*a* of the connector assembly 205. In addition to or in replacement of the aforementioned un-securing, the connector portion 204*b* of the shear assembly 204 is operable to un-secure from a connector portion 205*b* of the connector assembly 205.

The connector portions 205*a* and 205*b* of the connector assembly 205 may comprise one or more receiving portions 205*c*, such as a threaded hole, bore, female-type connector, or the like, similar to or substantially the same as the receiving portions 204*c* and 206*c* of the shear assembly 204 and sleeve assembly 206, respectively. Each receiving portion 205*c* (as well as receiving portions 204*c* and 206*c*) may be operable to receive a complimentary locking member 209, such as a screw, a male-type connector, or the like. It is to be understood in the present disclosure that each receiving portion 205*c* (as well as receiving portions 204*c* and 206*c*) and corresponding locking member 209 may be in other shapes and forms other than a screw and threaded hole, including any other lockable/unlockable connector types. It is also to be understood in the present disclosure that the receiving portions 204*c*, 206*c*, and/or 205*c* and/or the locking members for use in inserting and locking into the receiving portions 204*c*, 206*c*, and/or 205*c* (when performing a securing operation) and unlocking and removing from the receiving portions 204*c*, 206*c*, and/or 205*c* (when performing an un-securing and/or re-use operation) may be the same, similar, or different receiving portions and/or types of locking members, respectively.

Figure 4A:
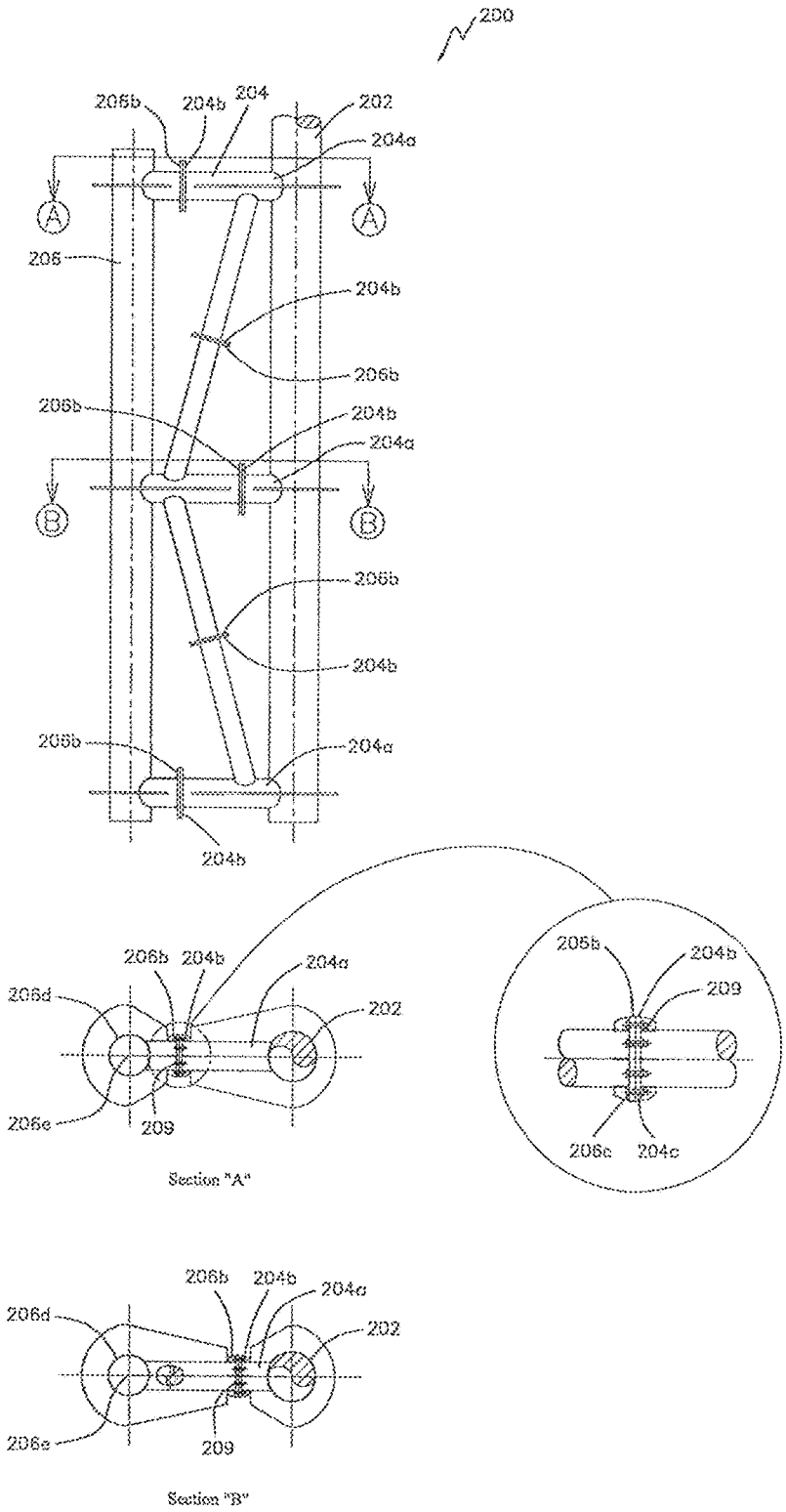
FIG. 4A is a side view illustration of another example embodiment of an offshore platform wherein the shear assembly is securable to and un-securable from the sleeve assembly.
Figure 4B:
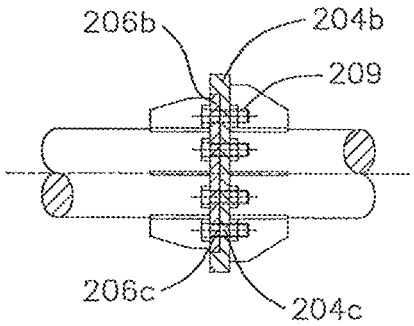
FIG. 4B is another side view illustration of other example embodiments of an offshore platform wherein the shear assembly is securable to and un-securable from the sleeve assembly.
Figure 4B:
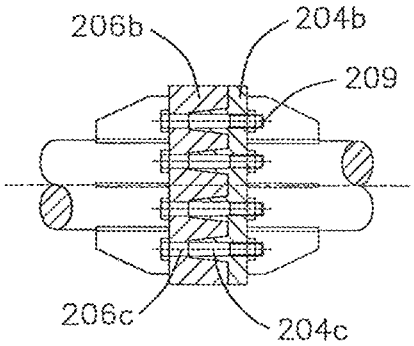

FIG. 4A illustrates another example embodiment of an offshore platform 200 comprising a shear assembly 204 and sleeve assembly 206. The shear assembly 204 may be securable to the sleeve assembly 206 (when performing a securing operation) and unsecurable from the sleeve assembly 206 (when performing an un-securing and/or re-use operation). FIG. 4B illustrates a side perspective view of example embodiments of the shear assembly 204 and the sleeve assembly 206.

As shown in FIGS. 4A and 4B, the connector portion 206*b* of the sleeve assembly 206 is provided in the form of an annular plate, or the like, attached to the remaining portion (such as a portion of the sleeve body) of the sleeve assembly 206. Correspondingly, the connector portion 204*b* of the shear assembly 204 is provided in the form of an opposing annular plate, or the like, attached to the remaining portion (such as a portion of the shear body) of the shear assembly 204. Similar to the example embodiment of FIGS. 2A and 2B, each connector portion 206*b* of the sleeve assembly and connector portion 204*b* of the shear assembly 204 may comprise one or more receiving portions 206*c* and 204*c*, respectively, such as a threaded hole, bore, female-type connector, or the like. Each receiving portion 204*c* and 206*c* may be operable to receive a complimentary locking member 209, such as a screw, a male-type connector, or the like. It is to be understood in the present disclosure that each receiving portion 204*c* and 206*c* and corresponding locking member 209 may be in other shapes and forms other than a screw and threaded hole, including any other lockable/unlockable connector types. It is also to be understood in the present disclosure that the receiving portions 204*c* and 206*c* and/or the locking members for use in inserting and locking into the receiving portions 204*c* and 206*c* (when performing a securing operation) and unlocking and removing from the receiving portions 204*c* and 206*c* (when performing an un-securing and/or re-use operation) may be the same, similar, or different receiving portions and/or types of locking members, respectively.

Figure 5A:
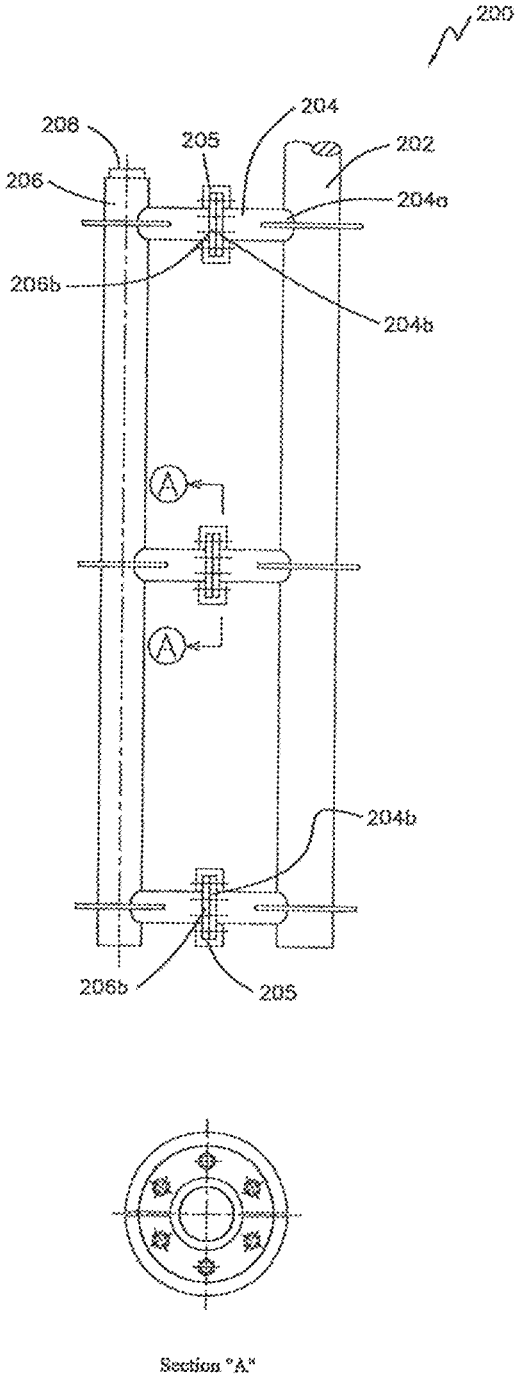
FIG. 5A is a side view illustration of another example embodiment of an offshore platform wherein the shear assembly is securable to and un-securable from the sleeve assembly via a connector assembly.
Figure 5B:
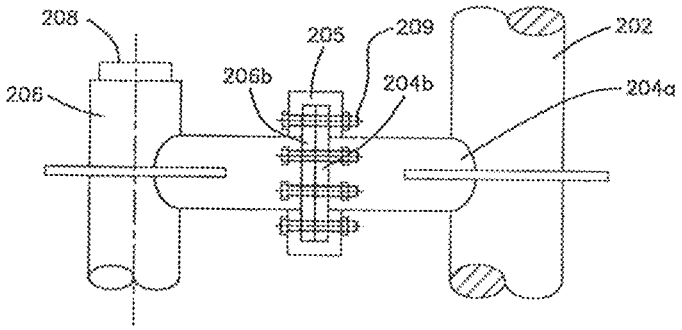
FIG. 5B is another side view illustration of an example embodiment of an offshore platform wherein the shear assembly is securable to and un-securable from the sleeve assembly via a connector assembly.
Figure 5B:
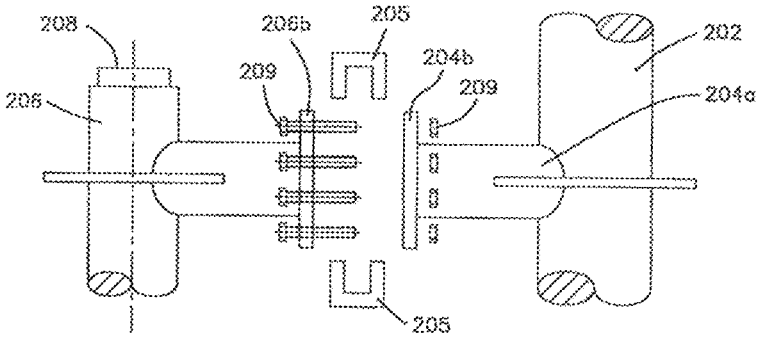

FIG. 5A illustrates another example embodiment of an offshore platform 200. The offshore platform 200 comprises a shear assembly 204, sleeve assembly 206, and connector assembly 205. The shear assembly 204 may be securable to the sleeve assembly 206 via the connector assembly 205 (when performing a securing operation) and un-securable from the sleeve assembly 206 via the connector assembly 205 (when performing an un-securing and/or re-use operation). FIG. 5B illustrates a side perspective view of example embodiments of the shear assembly 204, sleeve assembly 206, and connector assembly 205.

The example embodiments illustrated in FIGS. 5A and 5B are similar to the example embodiments illustrated in FIGS. 4A and 4B, but with an additional connector assembly 205 included to provide further support and/or strength to the securing/locking of the shear assembly 204 to the sleeve assembly 206. Accordingly, when performing a securing operation, the connector portion 205*a* of the connector assembly 205 is operable to secure together the connector portions 204*b* and 206*b*. Similarly, when performing an un-securing and/or re-use operation, the connector portion 205*a* of the connector assembly 205 is operable to un-secure the connector portion 204*b* from the connector portion 206*b*.

The connector portion 205*a* of the connector assembly 205 may comprise one or more receiving portions 205*c*, such as a threaded hole, bore, female-type connector, or the like, similar to the receiving portions 204*c* and 206*c* of the shear assembly 204 and sleeve assembly 206, respectively. Each receiving portion 205*c* (as well as receiving portions 204*c* and 206*c*) may be operable to receive a complimentary locking member 209, such as a screw, a male-type connector, or the like. It is to be understood in the present disclosure that each receiving portion 205*c* (as well as receiving portions 204*c* and 206*c*) and corresponding locking member 209 may be in other shapes and forms other than a screw and threaded hole, including any other lockable/unlockable connector types. It is also to be understood in the present disclosure that the receiving portions 204*c*, 206*c*, and/or 205*c* and/or the locking members for use in inserting and locking into the receiving portions 204*c*, 206*c*, and/or 205*c* (when performing a securing operation) and unlocking and removing from the receiving portions 204*c*, 206*c*, and/or 205*c* (when performing an un-securing and/or re-use operation) may be the same, similar, or different receiving portions and/or types of locking members, respectively.

Securing/Locking and Un-Securing/Unlocking at Sleeve Assembly (e.g., FIGS. 6 to 9).

Figure 6A:
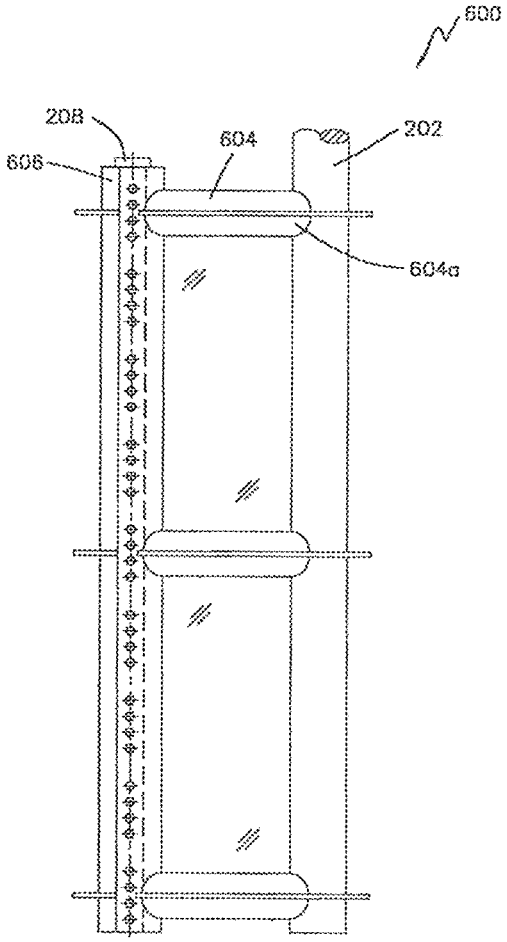
FIG. 6A is a side view illustration of an example embodiment of an offshore platform wherein the sleeve assembly is securable to and un-securable from a pile.
Figure 6B:
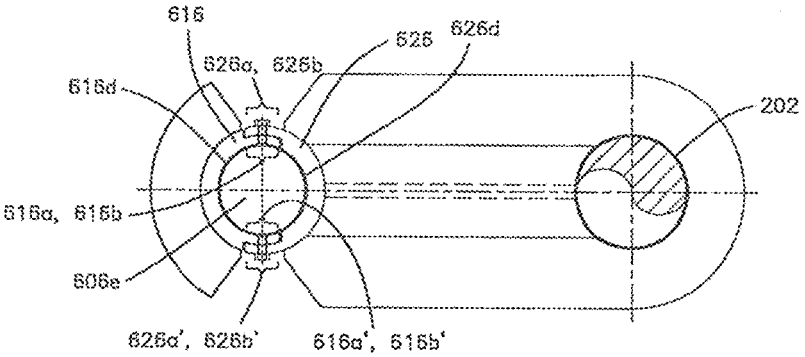
FIG. 6B is a top view illustration of an example embodiment of an offshore platform wherein the sleeve assembly is securable to and un-securable from a pile.
Figure 6C:
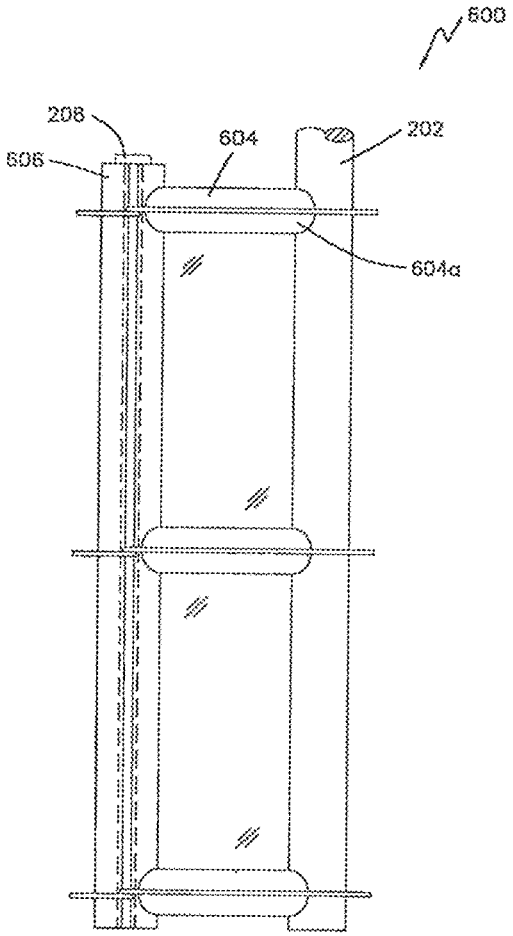
FIG. 6C is a top view illustration of another example embodiment of an offshore platform wherein the sleeve assembly is securable to and un-securable from a pile.
Figure 6C:
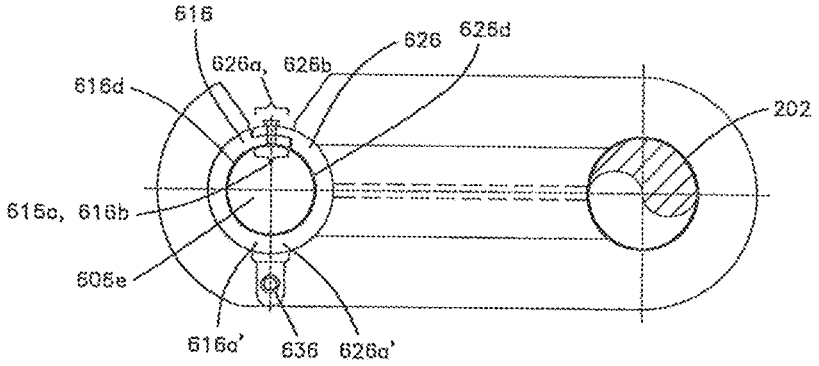

As illustrated in at least FIG. 6A, an offshore platform 600 may comprise a shear assembly 604 and a sleeve assembly 606. One or more portions of the sleeve assembly 606 may be transitionable between a secured position (when performing a securing operation) and an un-secured position (when performing an un-securing and/or re-use operation). FIG. 6B illustrates a top perspective view of an example embodiment of the shear assembly 604 and sleeve assembly 606, and FIG. 6C illustrates a top perspective view of another example embodiment of the shear assembly 604 and sleeve assembly 606.

The shear assembly 604 may be connected to a leg 202 of the offshore platform at a first end 604*a* of the shear assembly 604. For example, the first end 604*a* of the shear assembly 604 may be permanently attached to the leg 202, such as by welding, or other known methods. In example embodiments, the first end 604*a* of the shear assembly 604 may also be securable to and un-securable from the leg 202. The shear assembly 604 may also be connected to at least a portion (such as a portion of the sleeve body) of the sleeve assembly 606. For example, as shown in FIG. 6B, the shear assembly 604 may be permanently attached to a portion of the sleeve assembly 606, such as by welding, or other known methods.

The sleeve assembly 606 may comprise a first sleeve body portion 616 having an interior surface 616*d* and a second sleeve body portion 626 having an interior surface 626*d*. It is to be understood that the sleeve assembly 606 may comprise more than two sleeve body portions 616 and 626 without departing from the teachings of the present disclosure. The first sleeve body portion 616 may further comprise a connector portion 616*b* at a first end 616*a*. The second sleeve body portion 626 may further comprise a connector portion 626*b* at a first end 626*a* operable to secure to connector portion 616*b* (when performing a securing operation) and un-secure from connector portion 616*b* (when performing an un-secure and/or re-use operation). Such securing is achievable by, for example, inserting and locking one or more locking members 609 into one or more corresponding receiving portions 616*c* of the connector portion 616*b* of the first sleeve body portion 616 and one or more corresponding receiving portions 626*c* of the connector portion 626*b* of the second sleeve body portion 626. Similarly, un-securing is achievable by, for example, unlocking and removing the one or more locking members 609 from the one or more corresponding receiving portions 616*c* of the connector portion 616*b* of the first sleeve body portion 616 and the one or more corresponding receiving portions 626*c* of the connector portion 626*b* of the second sleeve body portion 626. The receiving portions 616*c* and 626*c* may be in the form of a hole, bore, female-type connector, or the like.

In the example embodiment illustrated in FIG. 6B, each of the first sleeve body portion 616 and second sleeve body portion 626 may further comprise a second set of connector portions 616*b*' and 626*b*' at a second end 616*a*' of the first sleeve body portion 616 and second end 626*a*' of the second sleeve body portion 626, respectively. Securing, un-securing, and re-using operations for the second set of connector portions 616*b*' and 626*b*' at the second ends 616*a*' and 626*a*' are performable in substantially the same manner as described above for the first set of connector portions 616*b* and 626*b*.

In another example embodiment illustrated in FIG. 6C, a hinge 636, or the like, may be provided in addition to or replacement of the aforementioned second set of connector portions 616*b*' and 626*b*' (as illustrated in FIG. 6B). The hinge 636 may be connected between second end 616*a*' of the first sleeve body portion 616 and second end 626*a*' of the second sleeve body portion 626.

The interior opening 606*e* of the example embodiments illustrated in FIGS. 6B and 6C may be formable by, among other things, the interior surfaces 616*d* and 626*d* of the first sleeve body portion 616 and the second sleeve body portion 626, respectively. The interior opening 606*e* may be operable to receive at least a pile 208. In example embodiments, the first sleeve body portion 616 and/or the second sleeve body portion 626 may be operable to secure to a pile 208 by swaging, or the like. It is recognized in the present disclosure that such mechanical-based securing of the sleeve assembly 606 to a pile 208 enables the un-securing and/or re-using of the offshore platform 200 and 600. It is to be understood in the present disclosure that the interior opening 606*e* of the sleeve assembly 606 may be in any shape or form so long as the interior opening 606*e* is operable to receive and house at least a corresponding pile 208. From a cross-sectional perspective, the interior opening 606*e* may be in the shape of a circular, elliptical, square, rectangular, or other shaped cross-section. From an overall channel perspective, the interior opening 606*e* may be in the form of an elongated cylindrical, elliptical, square, rectangular, or other shaped channel.

Figure 7A:
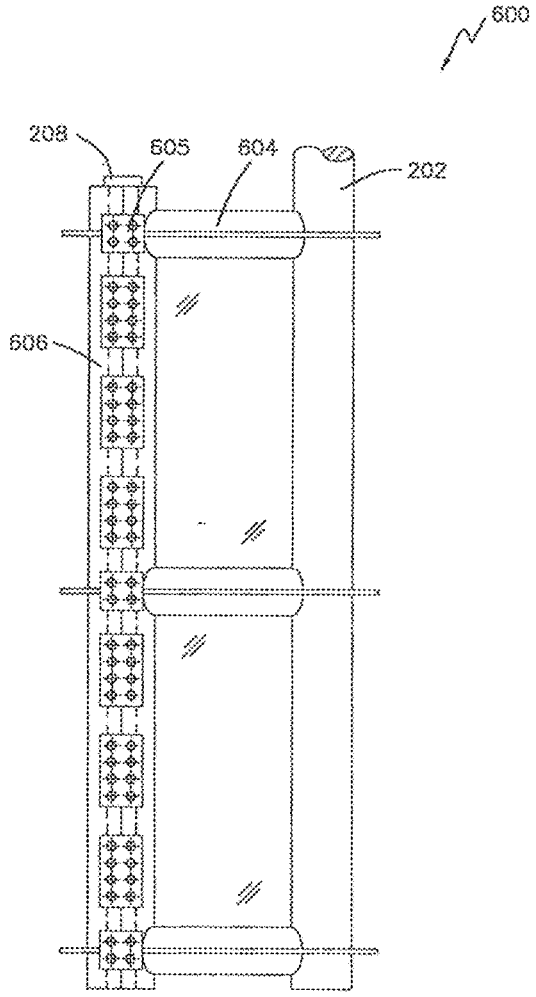
FIG. 7A is a side view illustration of another example embodiment of an offshore platform wherein the sleeve assembly is securable to and un-securable from a pile via a connector assembly.
Figure 7B:
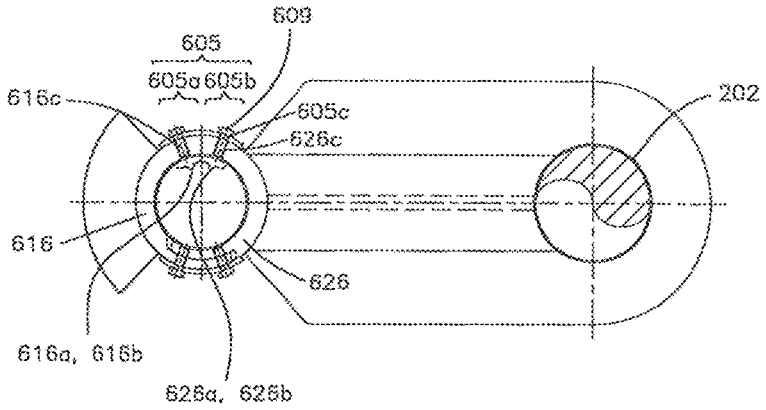
FIG. 7B is a top view illustration of an example embodiment of an offshore platform wherein the sleeve assembly is securable to and un-securable from a pile via a connector assembly.

FIG. 7A illustrates a side perspective view of another example embodiment of an offshore platform 600 and FIG. 7B illustrates a top perspective view of a possible configuration of the example embodiment of FIG. 7A. The offshore platform 600 comprises a shear assembly 604, sleeve assembly 606, and connector assembly 605. The sleeve assembly 606 comprises a first sleeve body portion 616 and second sleeve body portion 626. The first sleeve body portion 616 may be securable to the second sleeve body portion 626 via the connector assembly 605 (when performing a securing operation) and un-securable from the second sleeve body portion 626 via the connector assembly 605 (when performing an un-securing and/or re-use operation).

FIGS. 7A and 7B illustrate example embodiments similar to the example embodiments illustrated in FIGS. 6A, 6B, and 6C, but differ in that the example embodiments illustrated in FIGS. 7A and 7B further comprise connector assembly 605. When performing a securing operation, the connector portion 616*b* of the first sleeve body portion 616 is operable to secure to a connector portion 605*a* of the connector assembly 605 and the connector portion 626*b* of the second sleeve body portion 626 is operable to secure to a connector portion 605*b* of the connector assembly 605.

The connector portions 605*a* and 605*b* of the connector assembly 605 may comprise one or more receiving portions 605*c*, such as a threaded hole, bore, female-type connector, or the like, similar to or substantially the same as the receiving portions 616*c* and 626*c* of the first sleeve body portion 616 and second sleeve body portion 626, respectively. Each receiving portion 605*c* (as well as receiving portions 616*c* and 626*c*) may be operable to receive a complimentary locking member 609, such as a screw, a male-type connector, or the like. It is to be understood in the present disclosure that each receiving portion 605*c* (as well as receiving portions 616*c* and 626*c*) and corresponding locking member 609 may be in other shapes and forms other than a screw and threaded hole, including any other lockable connector types. It is also to be understood in the present disclosure that the receiving portions 616*c*, 626*c*, and/or 605*c* and/or the locking members for use in inserting and locking into the receiving portions 616*c*, 626*c*, and/or 605*c* (when performing a securing operation) and unlocking and removing from the receiving portions 616*c*, 626*c*, and/or 605*c* (when performing an un-securing and/or re-use operation) may be the same, similar, or different receiving portions and/or types of locking members, respectively.

Figure 8A:
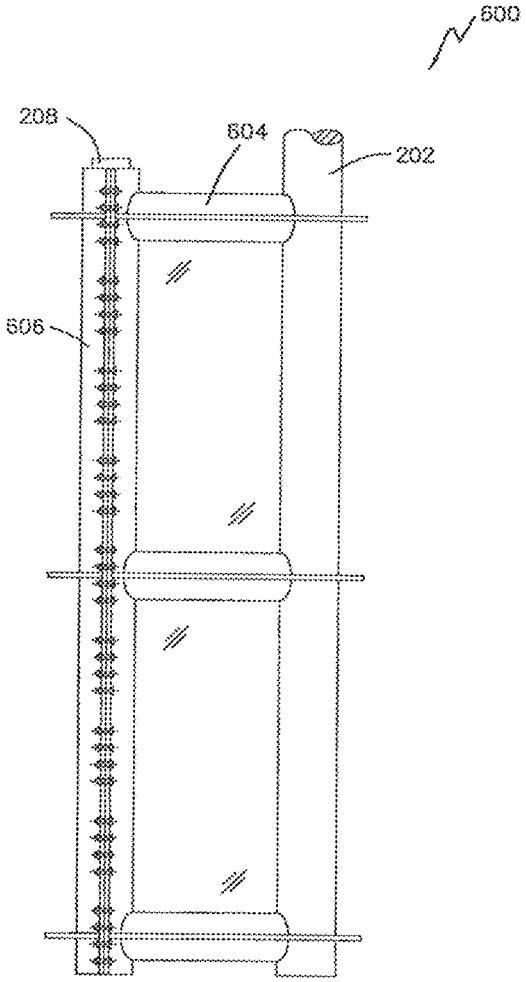
FIG. 8A is a side view illustration of another example embodiment of an offshore platform wherein the sleeve assembly is securable to and un-securable from a pile.
Figure 8B:
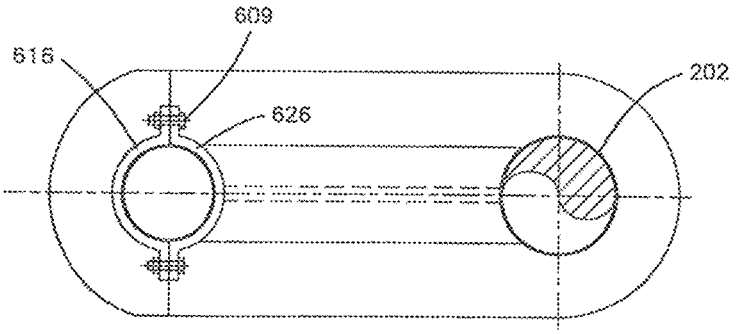
FIG. 8B is a top view illustration of an example embodiment of an offshore platform wherein the sleeve assembly is securable to and un-securable from a pile.
Figure 8C:
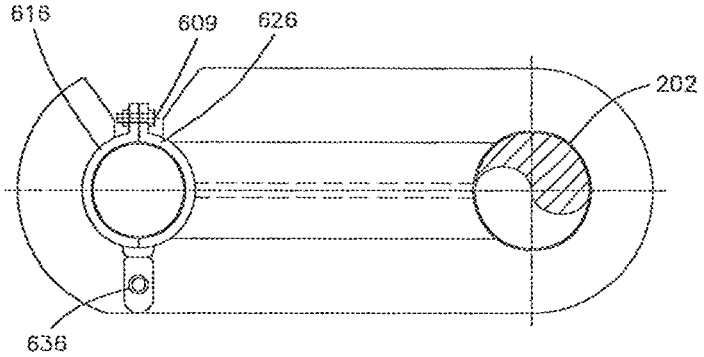
FIG. 8C is a top view illustration of another example embodiment of an offshore platform wherein the sleeve assembly is securable to and un-securable from a pile.

FIG. 8A illustrates a side perspective view of another example embodiment of an offshore platform 600, FIG. 8B illustrates a top perspective view of a possible configuration of the example embodiment of FIG. 8A, and FIG. 8C illustrates a top perspective view of another possible configuration of the example embodiment of FIG. 8A. The offshore platform 600 comprises a shear assembly 604 and sleeve assembly 606. The sleeve assembly 606 comprises a first sleeve body portion 616 and second sleeve body portion 626. The first sleeve body portion 616 may be securable to the second sleeve body portion 626 (when performing a securing operation) and un-securable from the second sleeve body portion 626 (when performing an un-securing and/or re-use operation).

Figure 9A:
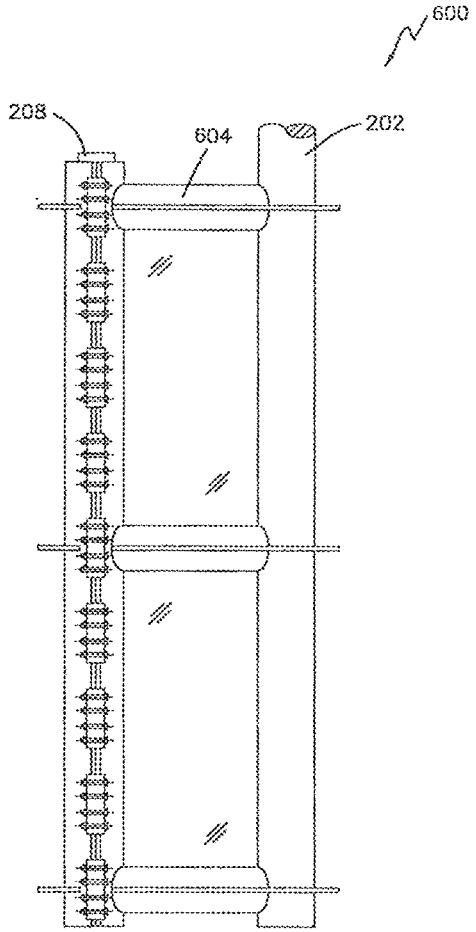
FIG. 9A is a side view illustration of another example embodiment of an offshore platform wherein the sleeve assembly is securable to and un-securable from a pile via a connector assembly.
Figure 9B:
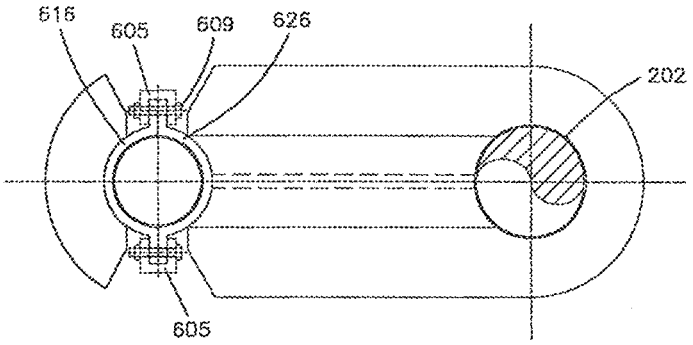
FIG. 9B is a top view illustration of an example embodiment of an offshore platform wherein the sleeve assembly is securable to and un-securable from a pile via a connector assembly.

FIG. 9A illustrates a side perspective view of another example embodiment of an offshore platform 600, and FIG. 9B illustrates a top perspective view of the example embodiment of FIG. 9A. The offshore platform 600 comprises a shear assembly 604, sleeve assembly 606, and connector assembly 605. The sleeve assembly 606 comprises a first sleeve body portion 616 and second sleeve body portion 626. The first sleeve body portion 616 may be securable to the second sleeve body portion 626 via the connector assembly 605 (when performing a securing operation) and un-securable from the second sleeve body portion 626 via the connector assembly 605 (when performing an un-securing and/or re-use operation).

The example embodiments illustrated in FIGS. 9A and 9B are similar to the example embodiments illustrated in FIGS. 8A, 8B, and 8C, but with an additional connector assembly 605 included to provide further support and/or strength to the securing of the first sleeve body portion 616 to the second sleeve body portion 626. Accordingly, when performing a securing operation, the connector portion 605*a* of the connector assembly 605 is operable to secure together the connector portions 616*b* and 626*b*. Similarly, when performing an un-securing and/or re-use operation, the connector portion 605*a* of the connector assembly 605 is operable to un-secure the connector portion 616*b* from the connector portion 626*b*.

The connector portion 605*a* of the connector assembly 605 may comprise one or more receiving portions 605*c*, such as a threaded hole, bore, female-type connector, or the like, similar to the receiving portions 616*c* and 626*c* of the first sleeve body portion 616 and second sleeve body portion 626, respectively. Each receiving portion 605*c* (as well as receiving portions 616*c* and 626*c*) may be operable to receive a complimentary locking member 609, such as a screw, a male-type connector, or the like. It is to be understood in the present disclosure that each receiving portion 605*c* (as well as receiving portions 616*c* and 626*c*) and corresponding locking member 609 may be in other shapes and forms other than a screw and threaded hole, including any other lockable connector types. It is also to be understood in the present disclosure that the receiving portions 616*c*, 626*c*, and/or 605*c* and/or the locking members 609 for use in inserting and locking into the receiving portions 616*c*, 626*c*, and/or 605*c* (when performing a securing operation) and unlocking and removing from the receiving portions 616*c*, 626*c*, and/or 605*c* (when performing an un-securing and/or re-use operation) may be the same, similar, or different receiving portions and/or types of locking members, respectively.

FIGS. 10A-D illustrate a side perspective view of example embodiments of an offshore platform 1000. As shown in each of the offshore platforms 1000 of FIGS. 10A-D, the offshore platform 1000 may comprise one or more shear assemblies 1004 and one or more sleeve assemblies 1006.

Each shear assembly 1004 may comprise a first end operable to secure to (or secured to) a leg 202 of the offshore platform. Each shear assembly 1004 may further comprise a second end operable to secure to a portion of the sleeve assembly 1006. In example embodiments, the second end of each shear assembly 1004 may be secured to a portion of a first sleeve body portion 1016 of a sleeve assembly 1006 and/or a portion of a second sleeve body portion 1026 of a sleeve assembly 1006.

Each sleeve assembly 1006 of each of the offshore platforms 1000 may comprise a first sleeve body portion 1016. Each sleeve assembly 1006 of each of the offshore platforms 1000 may further comprise a second sleeve body portion 1026. Each first sleeve body portion 1016 may be separate from each second sleeve body portion 1026 in example embodiments. Each first sleeve body portion 1016 of each sleeve assembly 1006 may be securable to a second sleeve body portion 1026 of each sleeve assembly 1006 when performing a securing operation. Each first sleeve body portion 1016 of each sleeve assembly 1006 may be unsecurable from a second sleeve body portion 1026 of each sleeve assembly 1006 when performing an un-securing and/or re-use operation.

As shown in FIGS. 10A-D, when performing a securing operation, a pile (not shown) may be insertable into an interior opening of the second sleeve body portion 1026 of each of the offshore platforms illustrated. Thereafter, the first sleeve body portion 1016 may be provided over the pile so as to house a portion of the pile in an interior opening of the first sleeve body portion 1016. Corresponding locking members 1009 may be provided so as to secure a connecting portion (or connector portion) of the first sleeve body portion 1016 to a corresponding connecting portion (or connector portion) of the second sleeve body portion 1026. The surfaces of the connecting portions of the first sleeve body portion 1016 and the second sleeve body portion 1026 that come into contact with one another when being secured using locking members 1009 may resemble a ring, or the like.

As shown in FIGS. 10A-D, when performing an un-securing operation, the locking members 1009 securing the connecting portions of the first sleeve body portion 1016 and the second sleeve body portion 1026 may be removed. Thereafter, the first sleeve body portion 1016, the interior opening of which was provided to receive and house the pile, may be removed by lifting the first sleeve body portion 1016 upwards (i.e., in a direction defined by one or more of the piles) and away from the pile. The offshore platform 1000 may then be removed by lifting upwards (i.e., in a direction defined by one or more of the piles).

Figure 10A:
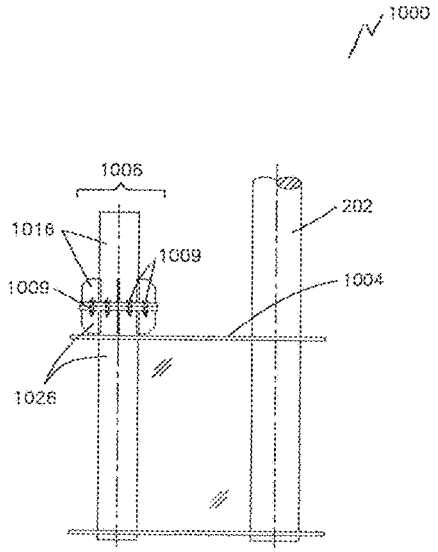
FIG. 10A is a side view illustration of another example embodiment of an offshore platform wherein the sleeve assembly is securable to and un-securable from a pile.
Figure 10B:
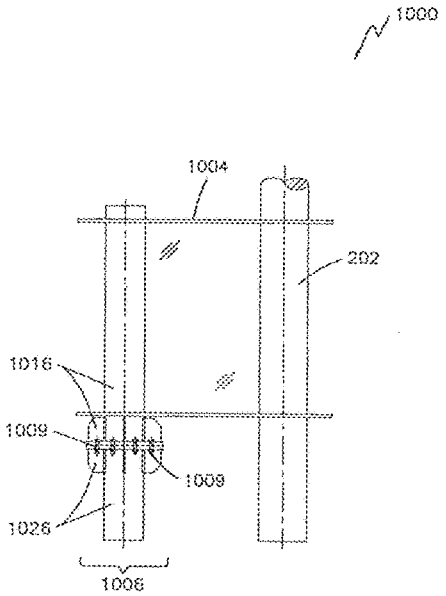
FIG. 10B is a side view illustration of another example embodiment of an offshore platform wherein the sleeve assembly is securable to and un-securable from a pile.
Figure 10C:
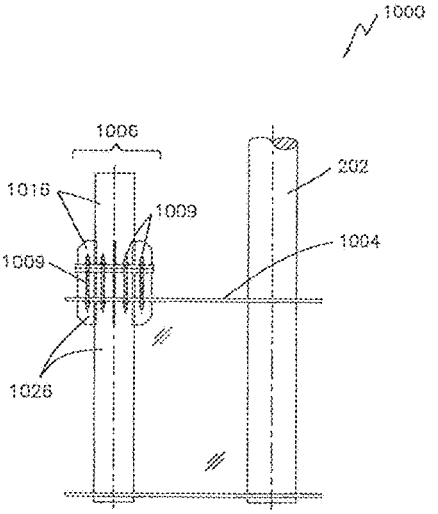
FIG. 10C is a side view illustration of another example embodiment of an offshore platform wherein the sleeve assembly is securable to and un-securable from a pile.

In the example embodiments illustrated in FIGS. 10A and 10C, the first sleeve body portion 1016 may have a closed end opposite to the end having the connecting portion. In this regard, the first sleeve body portion 1016 in FIGS. 10A and 10C may resemble a closed end, cap, cover, or the like. The first sleeve body portion 1016 and the second sleeve body portion 1026 may each comprise a connecting portion for securing the first sleeve body portion 1016 to the second sleeve body portion 1026 when an interior opening of the first sleeve body portion 1016 receives and houses an top end of the pile (i.e., the end of the pile protruding from the bottom of the body of water). Alternatively, the first sleeve body portion 1016 in FIGS. 10A and 10C may not have a fully closed end that resembles a closed end, cap, cover, or the like.

Figure 10D:
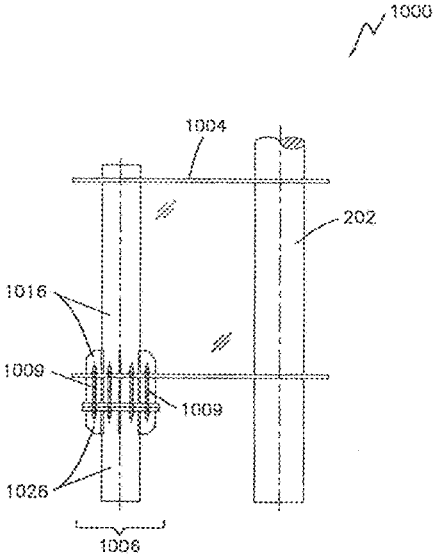
FIG. 10D is a side view illustration of another example embodiment of an offshore platform wherein the sleeve assembly is securable to and un-securable from a pile.

In example embodiments, such as those illustrated in FIGS. 10B and 10D, the first sleeve body portion 1016 may be more elongated in shape as compared to the example embodiments in FIGS. 10A and 10C, and this more elongated first sleeve body portion 1016 may be operable to connect to one or more than one shear portions 1004. The first sleeve body portion 1016 illustrated in FIGS. 10B and 10D may have a closed end opposite to the end having the connecting portion. In this regard, the first sleeve body portion 1016 in FIGS. 10B and 10D may resemble an elongated closed end, cap, cover, or the like. The first sleeve body portion 1016 and the second sleeve body portion 1026 may each comprise a connecting portion for securing the first sleeve body portion 1016 to the second sleeve body portion 1026 when the first sleeve body portion 1016 is positioned over the top end of the pile (i.e., the end of the pile protruding from the bottom of the body of water). Alternatively, the first sleeve body portion 1016 in FIGS. 10A and 10C may not have a fully closed end that resembles a closed end, cap, cover, or the like. It is to be understood in the present disclosure that the first sleeve body portion 1016 and the second sleeve body portion 1026 may comprise the same, substantially the same, similar, or different shape(s) and/or dimension(s) without departing from the teachings of the present disclosure.

It is to be understood in the present disclosure that each locking member 1009 and its corresponding receiving portion may be in one or more other shapes and/or forms other than a screw and corresponding threaded hole, including any other lockable connector types. It is also to be understood in the present disclosure that the receiving portions and/or the locking members for use in inserting and locking into the receiving portions (when performing a securing operation) and unlocking and removing from the receiving portions (when performing an un-securing and/or re-use operation) may be the same, similar, or different receiving portions and/or types of locking members, respectively.

Combinability of Embodiments

It is to be understood that one or more of the connector portions described in the present disclosure, such as those illustrated in FIGS. 2 to 10, may be combinable with one another in an offshore platform without departing from the teachings of the present disclosure. For example, one or more of the connector portions between a shear assembly and a sleeve assembly described in the present disclosure, such as those illustrated in FIGS. 2 to 5, may be combinable with one or more of the connector portions of the sleeve assembly, such as those illustrated in FIGS. 6 to 9, and/or those illustrated in FIGS. 10A-D. Furthermore, one or more of the aforementioned configurations may also be combinable with a connector assembly between a shear assembly and a leg of the offshore platform. Furthermore, a sleeve assembly may comprise one or a combination of the connector portions described in the present disclosure, such as those illustrated in FIGS. 6 to 10.

Method of Securing an Offshore Platform.

Figure 11:
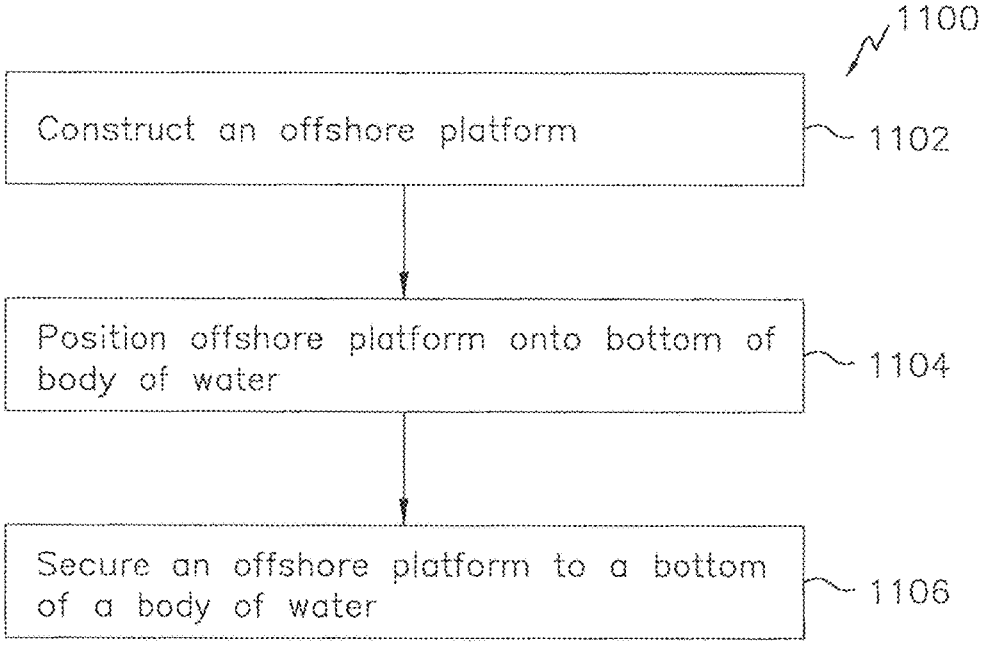
FIG. 11 is an example embodiment of a method of securing an offshore platform to a bottom of a body of water.

As depicted in the diagram of FIG. 11, an offshore platform, such as one or more example embodiments illustrated in at least FIGS. 2 to 10 and described in the present disclosure, may be secured to a bottom of a body of water in one or more of a plurality of ways. Provided below is an example embodiment of a method of securing an offshore platform to a bottom of a body of water.

Construct Offshore Platform (e.g., Action 1102).

The offshore platform may be substantially constructed (e.g., action 1102) on dry land. In doing so, the connector portions of the offshore platform, such as the connector portions of the shear assembly, sleeve assembly, connector assembly, first sleeve body portion, and/or second sleeve body portion, may be configured to be in the secured position so as to avoid performing such work on a transport ship and/or underwater.

Position Offshore Platform onto a Bottom of a Body of Water (e.g., Action 1104).

The constructed offshore platform (e.g., action 1102) may then be loaded onto a transport ship, transported to a desired location, and lowered in an upright position to a bottom of the body of water (e.g., action 1104).

Secure Offshore Platform to a Bottom of a Body of Water (e.g., Action 1106).

Once the offshore platform is lowered and positioned onto the bottom of the body of water, corresponding piles may then be inserted into the sleeve assemblies and driven into the bottom of the body of water (e.g., action 1106). The offshore platform may be considered as secured when all of the required piles have been inserted and driven as described above. If necessary, grout, swaging, or the like, may also be performed so as to secure a sleeve assembly to a pile.

Method of Un-Securing and/or Re-Using an Offshore Platform.

Figure 12:
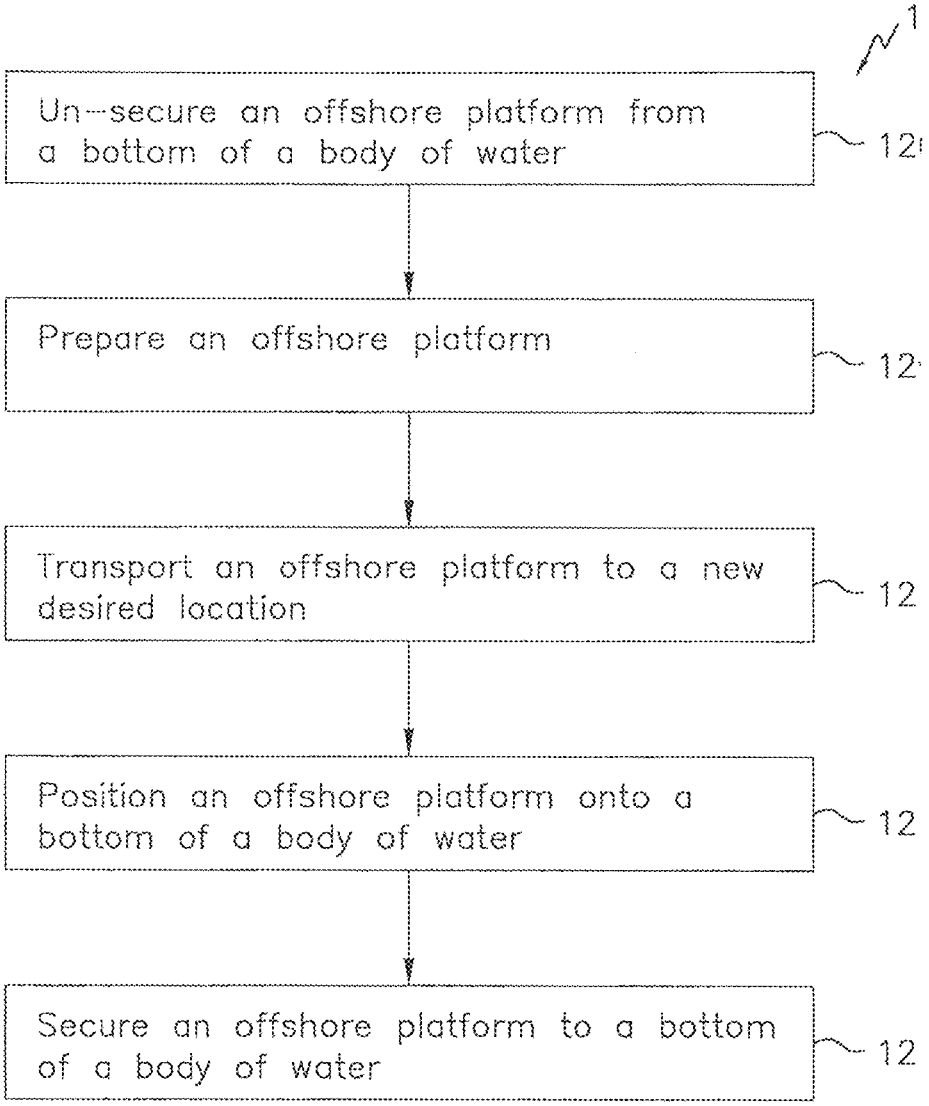
FIG. 12 is an example embodiment of a method of re-using an offshore platform already secured to a bottom of a body of water.

As depicted in the diagram of FIG. 12, an offshore platform, such as one or more of the example embodiments illustrated in at least FIGS. 2 to 10 and described in the present disclosure, that has been secured to a bottom of a body of water may be un-secured when the offshore platform is no longer required at that location and/or when the offshore platform is required to be re-used at another location. Provided below is an example embodiment of a method of un-securing and/or re-using an offshore platform already secured to a bottom of a body of water.

Un-Secure Offshore Platform from a Bottom of a Body of Water (e.g., Action 1202).

The secured offshore platform may be un-secured from a bottom of a body of water (e.g., action 1202) by transitioning its connector portions to an un-secured position. For example, the example embodiments illustrated in FIGS. 2 to 5 may be un-secured from a bottom of a body of water by removing a sufficient number of locking members 209 required to separate the shear assembly 204 from the sleeve assembly 206 of all securing assemblies 201 of the offshore platform. As another example, the example embodiments illustrated in FIGS. 6 to 10 may be unsecured from a bottom of a body of water by removing a sufficient number of locking members required to separate the first sleeve body portion of the sleeve assembly from the second sleeve body portion of the sleeve assembly. Once complete, the offshore platform will be un-secured from the bottom of the body of water.

(2) Prepare Offshore Platform (e.g., Action 1204).

After un-securing the offshore platform (e.g., action 1202), the offshore platform may be lifted onto a transport ship and transported to a new desired location. While on the transport ship (or on dry land, if available), the portions of the securing assembly 201 separated from the offshore platform after the un-securing operation may be replaced and secured with the remaining portions of the securing assembly 201 and 601 via locking members 209 and 609 (e.g., action 1204). For example, a new sleeve assembly 206 having a connector portion 206*b* may be replaced when re-using the example embodiments illustrated in FIGS. 2 to 5. For the example embodiments illustrated in FIGS. 3 and 5, the connector assembly 205 may also be replaced. As another example, a new first sleeve body portion 616 may be replaced when re-using the example embodiments illustrated in FIGS. 6B, 7B, 7C, 8B, and 9B. As another example, a new connector assembly 605 may be replaced when re-using the example embodiments illustrated in FIGS. 7 and 9. The securing assembly 201 of the example embodiments illustrated in FIGS. 6C and 8C may not need any replacement since all portions of the securing assembly 201 (except possibly the locking members 609) may remain intact. The securing assembly (i.e., the sleeve assembly and the shear assembly) of the example embodiments illustrated in FIGS. 10A-D may also not need any replacement since all portions of the securing assembly (except possibly the locking members) may be recoverable. Specifically, the first sleeve body portion and the second sleeve body portion of the sleeve assembly in such example embodiments may be recoverable and reused.

(3) Transport Offshore Platform to a New Desired Location (e.g., Action 1206).

After performing action 1204, the offshore platform may be transported (e.g., action 1206) on a transport ship, or the like, to a new desired location.

(4) Position Offshore Platform onto a Bottom of a Body of Water (e.g., Action 1208).

Once the transport ship reaches the new desired location (e.g., action 1206), the offshore platform may be lowered into the water in an upright position to a bottom of the body of water and positioned at a desirable location on the bottom of the body of water (e.g., action 1208).

(5) Secure Offshore Platform to a Bottom of a Body of Water (e.g., Action 1210).

The offshore platform may then be secured to the bottom of the body of water (e.g., action 1210) in substantially the same manner as described above and in the present disclosure for the method of securing an offshore platform.

While various embodiments in accordance with the disclosed principles have been described above, it should be understood that they have been presented by way of example only, and are not limiting. Thus, the breadth and scope of the example embodiments described in the present disclosure should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

For example, "assembly," "apparatus," "portion," "segment," "member," "body," "system,", "device," "platform," or other similar terms should generally be construed broadly to include one part or more than one part attached or connected together.

Various terms used herein have special meanings within the present technical field. Whether a particular term should be construed as such a "term of art" depends on the context in which that term is used. For example, "connect," "connected," "connecting," "connectable," "attach," "attached," "attaching," "attachable," "secure," "secured," "securing," "securable," "lock," "locked," "locking," "lockable," "anchor," "anchored," "anchoring," "anchorable," "install," "installed," "installing," "installable," "couple," "coupled," "coupling," "in communication with," "communicating with," "associated with," "associating with," "insert," "inserted," "inserting," "insertable," or other similar terms should generally be construed broadly to include situations where attachments, connections, installations, and anchoring are direct between referenced elements or through one or more intermediaries between the referenced elements. As another example, "un-connect," "un-connected," "un-connecting," "un-connectable," "un-attach," "un-attached," "un-attaching," "un-attachable," "un-secure," "un-secured," "un-securing," "un-securable," "unlock," "unlocked," "unlocking," "unlockable," "un-anchor," "un-anchored," "un-anchoring," "un-anchorable," "uninstall," "uninstalled," "uninstalling," "uninstallable," "uncouple," "uncoupled," "uncoupling," "un-insert," "un-inserted," "un-inserting," "un-insertable," or other similar terms should generally be construed broadly to include situations where separation, removal, and detaching are direct between referenced elements or from one or more intermediaries between the referenced elements. These and other terms are to be construed in light of the context in which they are used in the present disclosure and as one of ordinary skill in the art would understand those terms in the disclosed context. The above definitions are not exclusive of other meanings that might be imparted to those terms based on the disclosed context.

Words of comparison, measurement, and timing such as "at the time," "equivalent," "during," "complete," and the like should be understood to mean "substantially at the time," "substantially equivalent," "substantially during," "substantially complete," etc., where "substantially" means that such comparisons, measurements, and timings are practicable to accomplish the implicitly or expressly stated desired result.

Additionally, the section headings and topic headings herein are provided for consistency with the suggestions under various patent regulations and practice, or otherwise to provide organizational cues. These headings shall not limit or characterize the embodiments set out in any claims that may issue from this disclosure. Specifically, a description of a technology in the "Background" is not to be construed as an admission that technology is prior art to any embodiments in this disclosure. Furthermore, any reference in this disclosure to "invention" in the singular should not be used to argue that there is only a single point of novelty in this disclosure. Multiple inventions may be set forth according to the limitations of the claims issuing from this disclosure, and such claims accordingly define the invention(s), and their equivalents, that are protected thereby. In all instances, the scope of such claims shall be considered on their own merits in light of this disclosure, but should not be constrained by the headings herein.

What is claimed is:

1. An apparatus for securing an offshore platform to a bottom of a body of water, the apparatus comprising:

one or more elongated locking members;

a sleeve assembly having:

a first sleeve body portion having an interior surface, the first sleeve body portion having a receiving portion operable to receive one of the elongated locking members, a second sleeve body portion having an interior surface, and an interior opening formable by a cooperation of the interior surfaces of the first and second sleeve body portions when the first and second sleeve body portions are secured together, the interior opening operable to receive at least a pile;

a shear assembly having:

a first end operable to secure to a portion of the offshore platform, and a second end operable to secure to the sleeve assembly; and a connector assembly having a connector assembly body, the connector assembly body having:

a first connector portion at a first end of the connector assembly body, the first connector portion securable to a first end of the first sleeve body portion, the first connector portion having a receiving portion operable to receive one of the elongated locking members, and a second connector portion at a second end of the connector assembly body, the second connector portion securable to a first end of the second sleeve body portion.

2. The apparatus of claim 1, wherein the first connector portion is securable to a first end of the first sleeve body portion, the second connector portion is securable to a first end of the second sleeve body portion, and a second end of each of the first and second sleeve body portions are securable together by a joint.

3. The apparatus of claim 1, further comprising a second connector assembly body, wherein the second connector assembly body comprises:

a third connector portion at a first end of the second connector assembly body, the third connector portion securable to a second end of the first sleeve body portion, and a fourth connector portion at a second end of the second connector assembly body, the fourth connector portion securable to a second end of the first sleeve body portion;

wherein the third connector portion is securable to and un-securable from the fourth connector portion.

4. The apparatus of claim 3, wherein the first sleeve body portion is secured to the second sleeve body portion when:

the first connector portion is secured to the second connector portion, and the third connector portion is secured to the fourth connector portion.

5. The apparatus of claim 3, wherein the first sleeve body portion is un-secured from the second sleeve body portion when:

the first connector portion is un-secured from the second connector portion, and the third connector portion is un-secured from the fourth connector portion.

6. The apparatus of claim 1, wherein each of the second connector portion and the second sleeve body portion comprise a receiving portion operable to receive one of the elongated locking members.

7. The apparatus of claim 1, further comprising one or more other connector assemblies.

8. The apparatus of claim 7, wherein each of the one or more other connector assemblies is operable to secure the first sleeve body portion to the second sleeve body portion and un-secure the first sleeve body portion from the second sleeve body portion.

9. An apparatus for securing an offshore platform to a bottom of a body of water, the apparatus comprising:

a sleeve assembly having:

a first sleeve body portion having an interior opening and a first connector portion, the interior opening of the first sleeve body portion operable to receive at least a portion of a pile; and a second sleeve body portion separate from the first sleeve body portion, the second sleeve body portion having an interior opening and a second connector portion, the second connector portion securable to and un-securable from the first connector portion of the first sleeve body portion, the interior opening of the second sleeve body portion operable to receive at least a portion of the pile; and a shear assembly having:

a first end operable to secure to the offshore platform; and a second end operable to secure to a portion of the first sleeve body portion.

10. The apparatus of claim 9, wherein the first connector portion is provided at a bottom end of the first sleeve body portion and the second connector portion is provided at a top end of the second sleeve body portion.

11. The apparatus of claim 10, wherein a top end of the first sleeve body portion is a capped or covered end.

12. The apparatus of claim 9, wherein the first sleeve body portion is secured to the second sleeve body portion when the first connector portion is secured to the second connector portion.

13. The apparatus of claim 9, wherein the first sleeve body portion is un-secured from the second sleeve body portion when the first connector portion is un-secured from the second connector portion.

14. The apparatus of claim 9, further comprising one or more elongated locking members, wherein each of the first connector portion and the second connector portion comprise one or more corresponding receiving portions operable to receive the one of the elongated locking members.

* * * * *